US007223510B2

(12) United States Patent
Matsui et al.

(10) Patent No.: US 7,223,510 B2
(45) Date of Patent: May 29, 2007

(54) TONER, METHOD FOR MANUFACTURING THE TONER, METHOD AND DEVICE FOR PACKING THE TONER, AND IMAGE FORMING APPARATUS USING THE TONER

(75) Inventors: Kazuyuki Matsui, Fuji (JP); Noboru Kuroda, Tagata-gun (JP); Kifuku Takagi, Suntoh-gun (JP); Masato Kobayashi, Suntoh-gun (JP)

(73) Assignee: Ricoh Company Limited, Tokyo (JP)

( * ) Notice: Subject to any disclaimer, the term of this patent is extended or adjusted under 35 U.S.C. 154(b) by 298 days.

(21) Appl. No.: 10/849,857

(22) Filed: May 21, 2004

(65) Prior Publication Data

US 2004/0234882 A1 Nov. 25, 2004

(30) Foreign Application Priority Data

May 22, 2003 (JP) ..... 2003-144666
Aug. 11, 2003 (JP) ..... 2003-291179

(51) Int. Cl.
*G03G 9/08* (2006.01)

(52) U.S. Cl. ..... 430/110.3; 430/137.1

(58) Field of Classification Search ..... 430/110.3, 430/137.1

See application file for complete search history.

(56) References Cited

U.S. PATENT DOCUMENTS

| | | | | |
|---|---|---|---|---|
| 5,938,045 | A | 8/1999 | Makino et al. | |
| 6,183,926 | B1 | 2/2001 | Kuroda et al. | |
| 6,200,719 | B1 | 3/2001 | Kuroda | |
| 6,245,129 | B1 | 6/2001 | Yoshikawa | |
| 6,258,502 | B1 | 7/2001 | Nakamura et al. | |
| 6,395,443 | B2 | 5/2002 | Kuroda et al. | |
| 6,432,590 | B1 | 8/2002 | Ueda et al. | |
| 2003/0162112 | A1* | 8/2003 | Yamashita et al. | 430/108.6 |
| 2004/0013961 | A1* | 1/2004 | Niwa et al. | 430/107.1 |

FOREIGN PATENT DOCUMENTS

| | | | |
|---|---|---|---|
| EP | 0 906 931 | A2 | 4/1999 |
| EP | 1 254 835 | A2 | 11/2002 |
| EP | 1 424 603 | A2 | 6/2004 |
| EP | 1 441 259 | A1 | 7/2004 |
| JP | 61-22354 | | 1/1986 |
| JP | 2-148046 | | 6/1990 |
| JP | 5-313416 | | 11/1993 |
| JP | 6-250439 | | 9/1994 |
| JP | 7-152202 | | 6/1995 |
| JP | 9-68823 | | 3/1997 |
| JP | 10-39541 | | 2/1998 |
| JP | 11-149179 | | 6/1999 |
| JP | 2001-255698 | | 9/2001 |
| JP | 2002-148863 | | 5/2002 |
| JP | 2002-207317 | | 7/2002 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A method for producing a toner including dissolving or dispersing a toner constituent mixture including a binder resin and a colorant in an organic solvent to prepare a toner constituent mixture liquid; dispersing the toner constituent mixture liquid in an aqueous medium including a particulate dispersant to prepare an emulsion; and removing the organic solvent from the emulsion while applying a shearing force to the emulsion. A toner manufactured by the method and having a spindle form while satisfying specific particle diameter relationships. An image forming apparatus using the toner. A toner packing method and device in which the toner is fluidized and pressurized to be fed from a fluidizing container to a toner container on which a gas-powder separation sieve is set to discharge air therefrom.

10 Claims, 10 Drawing Sheets

TONER, METHOD FOR MANUFACTURING THE TONER, METHOD AND DEVICE FOR PACKING THE TONER, AND IMAGE FORMING APPARATUS USING THE TONER

BACKGROUND OF THE INVENTION

1. Field of the Invention

The present invention relates to a toner for use in developing electrostatic latent images prepared by a method such as electrophotography, electrostatic recording and electrostatic printing. More particularly, the present invention relates to a toner for use in image forming apparatus such as copiers, printers and plain paper facsimiles, which utilize a direct or indirect developing method. In addition, the present invention also relates to a method for manufacturing the toner, an image forming apparatus and a process cartridge using the toner, and a method and a device for packing the toner.

2. Discussion of the Background

In electrophotographic image forming apparatus, images are typically formed by the following method:

(1) an image bearing member such as photoreceptors is charged with a charger (charging process);
(2) the charged image bearing member is exposed to image-wise light to form an electrostatic latent image on the image bearing member (light irradiating process);
(3) the electrostatic latent image is developed with a developer including a toner to form a toner image on the image bearing member (developing process);
(4) the toner image is transferred onto a receiving material optionally via an intermediate transfer medium (transfer process);
(5) the toner image is fixed on the receiving material by a fixing device upon application of heat, pressure and/or the like (fixing process); and
(6) toner particles remaining on the image bearing member even after the transfer process are removed by a cleaner so that the image bearing member can be ready for the next image forming processes.

Recently, images formed by electrophotography are requested to have high image qualities (especially, good image reproducibility) whether the images are monochrome images or color images. In particular, half tone images typically have a large image area proportion in full color images. Therefore, by improving image reproducibility of color toners, various color images can be faithfully reproduced. In attempting to produce high quality color images having good evenness and good color reproducibility, toners having a small particle diameter and/or a spherical form have been proposed and developed.

Published unexamined Japanese Patent Applications Nos. (hereinafter JP-As) 2002-148863, 05-313416 and 02-148046 have disclosed methods for manufacturing a spherical toner which include the following processes:

(1) mother toner particles including at least a binder resin and a colorant are dispersed in water or an aqueous solvent including a dispersant to prepare a dispersion;
(2) a mixture of a softening agent which can soften the mother toner particles, and an organic solvent which can be mixed with water or the aqueous solvent and can dissolve the softening agent is added to the dispersion so that the mother toner particles absorb the softening agent; and
(3) the softening agent is removed from the mother toner particles.

By using these methods, spherical toners having a proper particle diameter distribution can be prepared without particularly limiting the binder resin.

However, the toners prepared by these methods have a drawback in that toner particles tend to invade into a gap between an image bearing member (e.g., a photoreceptor) and a cleaner (e.g., a cleaning blade) because of easily rolling (i.e., because of having an excessive rolling property), thereby causing a cleaning problem in that undesirable streak images are produced in the resultant images. In addition, the toners have a drawback in that when a dot image is developed and transferred, toner particles in a dot image scatters around the dot image due to their excessive rolling property, resulting in formation of toner scattering images.

In addition, JP-As 61-22354, 06-250439 and 09-68823 have disclosed toners which include toner particles including a colorant and a binder resin, wherein the toner particles have a volume average particle diameter of from 3 to 9 μm and a specific particle diameter distribution.

By using the toners having such a small particle diameter, images having good evenness can be produced without causing a background development problem in that the resultant images have background fouling which is caused by undesirable charge properties of the toners.

However, the toners have a drawback in that toner particles tend to invade into a gap between a photoreceptor and a cleaner in the cleaning process, resulting in occurrence of the cleaning problem. If the toners have an irregular form, the toners do not cause the cleaning problem. However, another problem occurs in that the resultant images have poor fine line reproducibility because toner particles move differently in the image developing process and the image transfer process.

In addition, JP-A 2002-207317 discloses a toner having a flat form. The toner is prepared by the following method:

(1) resin particles having an average primary particle diameter of from 10 to 500 nm is subjected to a salting-out/fusion treatment to prepare secondary particles of the resin; and
(2) the secondary resin particles are flattened to prepare the flat toner.

By using this flat toner, high image-density and high quality images having smooth surface can be produced without forming the toner-scattering problem mentioned above.

However, the toner has poor fluidity, and thereby the toner particles cannot be densely and uniformly arranged in a dot toner image. Therefore, when images are formed at a high dot (or linear) density, the toner images have poor dot reproducibility. The same is true for toners having an irregular form.

JP-A 07-152202 discloses a polymer solution dispersing method using a polymer solution dispersing technique utilizing shrinkage of the dispersed polymer solution. Specifically, the method is as follows:

(1) a toner constituent mixture including toner constituents such as binder resins and colorants is dispersed or dissolved in a volatile solvent such as organic solvents having a low boiling point to prepare a toner constituent mixture liquid;
(2) emulsifying the toner constituent mixture liquid in an aqueous medium including a dispersant to prepare drops of the toner constituent mixture liquid in the aqueous medium; and
(3) removing the volatile solvent, resulting in shrinkage of the liquid drops and formation of toner particles.

When a solid particulate material which is not dissolved in the aqueous medium is used as the dispersant, the resultant toner particles have an irregular form. However, when the solid content of the toner constituent mixture liquid is increased to improve the productivity, the viscosity of the toner constituent mixture liquid seriously increases, and thereby the average particle diameter of the resultant toner particles increases and the particle diameter distribution thereof is also broadened. If a resin having a low molecular weight is used as the binder resin to decrease the viscosity, a problem in that the fixability (particularly, the hot offset resistance) of the resultant toner deteriorates occurs.

JP-A 11-149179 discloses a modified polymer solution dispersing method in which a resin having low molecular weight is included in the toner constituent mixture liquid to decrease the viscosity of the toner constituent mixture liquid (resulting in easy emulsification of the toner constituent mixture liquid) and the low molecular weight resin is subjected to a polymerization reaction in the liquid drops to improve the fixability of the resultant toner. However, the method has drawbacks in that the resultant toner particles have broad particle diameter distribution; the surface of the toner particle is not smooth; and the shape of the toner particles cannot be controlled.

Because of these reasons, a need exists for a toner which has good cleanability and which can produce high quality images without causing the fogging problem and without deteriorating fine dot reproducibility.

SUMMARY OF THE INVENTION

Accordingly, an object of the present invention is to provide a toner which has good cleanability and which can produce high quality images having good fine dot reproducibility without causing the toner-scattering problem.

Another object of the present invention is to provide a method for manufacturing the toner.

Yet another object of the present invention is to provide an image forming apparatus and a process cartridge which can produce high quality images having good fine dot reproducibility using the toner without causing the toner-scattering problem.

A further object of the present invention is to provide a method and a device for filling a container with the toner using a simple packing device.

Briefly these objects and other objects of the present invention as hereinafter will become more readily apparent can be attained by a method for producing a toner including:

dissolving or dispersing a toner constituent mixture including a binder resin and a colorant in an organic solvent to prepare a toner constituent mixture liquid;

dispersing the toner constituent mixture liquid in an aqueous medium including a particulate dispersant to prepare an emulsion; and removing the organic solvent from the emulsion while applying a shearing force to the emulsion.

It is preferable that the organic solvent removing treatment is performed under a pressure lower than 101.3 kPa and/or supplying an inert gas such as a nitrogen gas into the emulsion.

It is preferable in the organic solvent removing treatment that the emulsion is supplied to a rotator to form a thin layer of the emulsion while a shearing force is applied to the emulsion to remove the organic solvent from the emulsion. The rotator preferably rotates at a peripheral velocity of from 10 to 60 m/sec.

Further, it is preferable that an inert gas is supplied into the emulsion to form bubbles in the emulsion, and the emulsion including the bubbles is supplied to the rotator to form a thin layer of the emulsion while a shearing force is applied thereto to remove at least the organic solvent from the emulsion. The inert gas is preferably a nitrogen gas, and the added amount of nitrogen gas is preferably from 0.1 to 70% by volume based on the volume of the emulsion.

As another aspect of the present invention, a toner is provided which includes a binder resin and a colorant and is produced by the method mentioned above. The toner has a spindle form and a volume average particle diameter of form 3 to 8 μm, and satisfied the following relationships:

$$0.5 \leqq (r2/r1) \leqq 0.8,\ 0.7 \leqq (r3/r2) \leqq 1.0, \text{ and } r3 < r2 < r1,$$

wherein r1, r2 and r3 represent an average major axis particle diameter, an average minor axis particle diameter and an average thickness of particles of the toner.

It is preferable that the average major axis particle diameter r1 is from 5 to 9 μm, the average minor axis particle diameter r2 is from 2 to 6 μm, and the average thickness r3 is from 2 to 6 μm. In addition, it is preferable that standard deviations, S1, S2 and S3, of the major axis particle diameter r1, the minor axis particle diameter r2 and the thickness r3 are not greater than 2.0 μm, not greater than 1.5 μm and not greater than 1.5 μm, respectively.

Further, it is preferable that toner particles having a thickness r3 not greater than 3 μm are included in the toner in an amount not greater than 30% by weight based on the total weight of the toner.

The toner preferably has an average form factor SF-2 of from 100 to 190, wherein the form factor of a toner particle is defined by the following formula (1):

$$SF\text{-}2 = \{(\mathrm{PERI})^2/\mathrm{AREA}\} \times (100\pi/4) \quad (1)$$

wherein PERI and AREA respectively represent a periphery length and an area of an image of a toner particle projected on a two-dimensional plane.

As yet another aspect of the present invention, an image forming apparatus is provided which includes:

an image bearing member configured to bear an electrostatic latent image thereon;

a developing device configured to develop the electrostatic latent image with a developer including the toner mentioned above to form a toner image on the image bearing member;

a transferring device configured to transfer the toner image onto a receiving material; and a cleaning device configured to clean a surface of the image bearing member.

As a further aspect of the present invention, a process cartridge for an image forming apparatus is provided which includes:

at least an image bearing member configured to bear an electrostatic latent image thereon; and a developing device configured to develop the electrostatic latent image with a developer comprising the toner mentioned above to form a toner image on the image bearing member.

As a still further aspect of the present invention, a toner packing method is provided which includes:

fluidizing a toner in a fluidizing device; and applying a pressure to the fluidized powder to feed the toner together with a gas (such as air, hereinafter referred to as air) in the fluidizing device to a toner container having a first gas-powder separation sieve while discharging air from the first gas-powder separation sieve.

It is preferable that the fluidizing operation and the pressure applying are performed by applying air to the fluidizing device through a second gas-powder separation sieve, wherein the area of the second gas-powder separation sieve is larger than that of the first gas-powder separation sieve, and wherein air is discharged from the first gas-powder separation sieve at a flow rate higher than that of air passing through the second gas-powder separation sieve.

It is possible that the fluidizing is performed by vibrating the fluidizing device.

The pressure applying operation can be performed by increasing the internal pressure of the fluidizing device by supplying air or decreasing the internal volume of the fluidizing device.

It is preferable to adjust the flow rate of air using a gas flow adjusting valve and to control the flow rate of air and the toner using a powder flow rate adjusting valve.

In addition, the fluidizing device preferably has an open valve, and the pressurizing operation is performed while the open valve is closed, and the open valve is opened when the toner feeding operation is completed.

Air can be supplied by a device such as pressure vessels, compressors, inflators and air pumps with a non-return valve.

It is preferable to supply air through an air distributor to uniformly supply air to the toner.

As a still further aspect of the present invention, a toner packing device is provided which includes:

a fluidizing device including:

a fluidizing container configured to contain a toner, wherein the fluidizing container can be closed; and a fluidizer configured to fluidize the toner in the container, a pressurizing device configured to increase an internal pressure of the fluidizing container to feed the toner in the fluidizing container together with air;

a filling nozzle configured to fill a toner container with the toner fed from the fluidizing device;

a first gas-powder separation sieve which is set on the toner container and which is configured to discharge air from the toner container; and a connector configured to connect the fluidity container with the filling nozzle.

The fluidizing device preferably includes:

a second gas-powder separation sieve; and a gas supplying device configured to supply air to the fluidizing container through the second gas-powder separation sieve to fluidize the toner in the fluidizing container. In this case, the gas supplying device also serves as the pressurizing device.

The fluidizer can be a vibrating device configured to vibrate the fluidizing container to fluidize the toner therein.

The pressurizing device can be a gas supplying device such as pressure vessels, compressors, inflators and air pumps with a non-return valve configured to increase a pressure in the fluidizing container by supplying air to the fluidizing container or a pressure applicator configured to press the fluidizing container to reduce the internal volume of the fluidizing container.

The toner packing device preferably has a gas flow adjusting member (such as valves) configured to adjust the flow rate of air and a powder flow rate adjusting member (such as valves) to control the flow rate of air and the toner.

The toner packing device preferably has an open valve disposed on the fluidizing container, and the pressurizing operation is performed while the open valve is closed, and the open valve is opened when a predetermined amount of toner is contained in the toner container.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
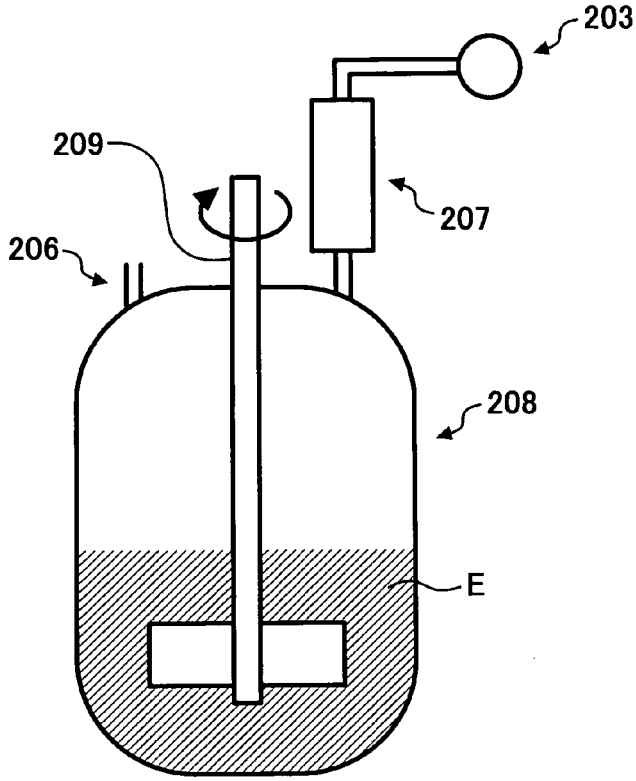
FIG. 1 is a schematic view illustrating a tank-form solvent removing device for use in controlling the shape of the toner of the present invention.

By using the toner manufacturing method of the present invention, a toner which can produce high quality toner images (particularly high definition toner images) on an image bearing member such as photoreceptors without causing toner scattering around the toner images and background areas. In addition, the toner images on the photoreceptors can be transferred at a high transfer rate without causing toner scattering. Further, the toner has a cleanability as good as that of toners having an irregular form and the toner can be efficiently produced.

Further, in the present invention, a toner packing method is provided which includes the following steps:

(1) injecting a gas (e.g., air) into a powder (e.g., a toner) to allow the powder to achieve a controlled flowing state (i.e., to fluidize the powder);

(2) feeding the toner and air to the bottom (inner) portion of a toner container such as containers having a small mouth or a special form; and (3) discharging air in the toner container through a gas-powder separator provided on the mouth of the toner container, to contain the toner in the toner container at a high density without causing toner scattering.

At first, the toner manufacturing method of the present invention will be explained.

The toner manufacturing method of the present invention includes the steps of:

(1) dissolving or dispersing a toner constituent mixture including at least a binder resin and a colorant in an organic solvent to prepare a toner constituent mixture liquid;

(2) dispersing the toner constituent mixture liquid in an aqueous medium including a particulate dispersant to prepare an emulsion; and (3) removing the organic solvent therefrom while applying a shearing force thereto.

Suitable resins for use as the binder resins include modified polyester resins such as polyester prepolymers (A) having an isocyanate group.

The prepolymers (A) are typically prepared by reacting a polycondensation product of a polyol (1) with a polycarboxylic acid (2), which has an active hydrogen, with a polyisocyanate (3). Specific examples of the groups having an active hydrogen include hydroxyl groups (such as alcoholic hydroxyl groups and phenolic hydroxyl groups), amino groups, carboxyl groups, mercapto groups, etc. Among these groups, alcoholic hydroxyl groups are preferable.

These resins can be reacted with a crosslinking agent and/or an elongation agent in the aqueous medium to be crosslinked or elongated, if desired. Suitable materials for use as the crosslinking agent and elongation agent include amine compounds (B).

The toner of the present invention preferably includes a urea-modified polyester (i), which is typically prepared by reacting a polyester prepolymer (A) having an isocyanate group with an amine (B), as the binder resin.

The modified polyester resin is defined as polyester resins which include a bonding group other than the ester bonding, and resins in which a resin unit other than polyester resin units is bonded with polyester units through a covalent bonding and an ionic bonding. For example, polyester resins which are prepared by the following method can be preferably used as the modified polyester:

(1) a functional group such as isocyanate groups which can react with an acid group and a hydroxyl group is incorporated in an end portion of a polyester resin; and (2) the polyester resin is further reacted with a compound having an active hydrogen so that the end portion thereof is modified.

Suitable polyols (1) include diols (1-1) and polyols (1-2) having three or more hydroxyl groups. Preferably diols (1-1) or mixtures in which a small amount of a polyol (1-2) is added to a diol (1-1) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide, and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids include dicarboxylic acids (2-1) and polycarboxylic acids (2-2) having three or more carboxyl groups. Preferably, dicarboxylic acids (2-1) or mixtures in which a small amount of a polycarboxylic acid (2-2) is added to a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more carboxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., $\alpha,\alpha,\alpha'$, $\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the unit obtained from a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3 and more preferably from 1.8 to 2.5. When the number of the isocyanate group is too small, the molecular weight of the resultant urea-modified polyester decreases and thereby hot offset resistance deteriorate.

Specific examples of the amines (B) include diamines (B1), polyamines (B2) having three or more amino groups, amino alcohols (B3), amino mercaptans (B4), amino acids (B5) and blocked amines (B6) in which the amines (B1–B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures of a diamine with a small amount of a polyamine (B2) are preferable.

The molecular weight of the urea-modified polyesters can be controlled using an elongation inhibitor, if desired. Specific examples of the elongation inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The urea-modified polyesters can be prepared, for example, by a method such as one-shot methods or prepolymer methods. The weight average molecular weight of the urea-modified polyesters is not less than 10,000, preferably from 15,000 to 10,000,000 and more preferably from 20,000 to 1,000,000. In addition, the peak molecular weight of the urea-modified polyesters is preferably from 1,000 to 10,000. In addition, the peak molecular weight is preferably from 1,000 to 10,000. When the peak molecular weight is too low, the hot offset resistance of the resultant toner deteriorates. In contrast, when the peak molecular weight is too high, the fixability of the toner deteriorates. In addition, it takes a long timer to perform granulizing and pulverizing, resulting in increase of manufacturing costs.

The number average molecular weight of the urea-modified polyester resin (i) is not particularly limited if an unmodified polyesterresin (ii) isusedincombination. Specifically, the weight average molecular weight of the urea-modified polyester resin (i) is mainly controlled rather than the number average molecular weight. When the urea-modified polyester resin (i) is used alone, the number average molecular weight of the resin (i) is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner, the resultant toner has low gloss.

It is preferable to use a combination of a urea-modified polyester resin with an unmodified polyester resin as the binder resin. By using a combination of a urea-modified polyester resin with an unmodified polyester resin, the low temperature fixability of the toner can be improved and in addition the toner can produce color images having a high gloss.

Suitable unmodified polyester resins include polycondensation products of a polyol with a polycarboxylic acid. Specific examples of the polyol and polycarboxylic acid are mentioned above for use in the modified polyester resins. In addition, specific examples of the suitable polyol and polycarboxylic acid are also mentioned above.

In addition, as the unmodified polyester resins, polyester resins modified by a bonding (such as urethane bonding) other than a urea bonding, can also be used as well as the unmodified polyester resins mentioned above.

When a combination of a modified polyester resin with an unmodified polyester resin is used as the binder resin, it is preferable that the modified polyester resin at least partially mixes with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 60/40, preferably from 5/95 to 30/70, more preferably from 5/95 to 25/75, and even more preferably from 7/93 to 20/80. When the addition amount of the modified polyester resin is too small, the hot offset resistance of the toner deteriorates and in addition, it is impossible to achieve a good combination of high-temperature preservability and low temperature fixability.

The peak molecular weight of the unmodified polyester resins is from 1,000 to 10,000, preferably from 2,000 to 8,000 and more preferably from 2,000 to 5,000. When the peak molecular weight is too low, the high-temperature preservability deteriorates. When the peak molecular weight is too high, the low temperature fixability deteriorates.

The unmodified polyester resin (ii) preferably has a hydroxyl value not less than 5 mgKOH/g, and more preferably from 10 to 120 mgKOH/g, and evenmore preferably from 20 to 80 mgKOH/g. When the hydroxyl value is too low, the resultant toner has poor preservability and poor low temperature fixability.

The unmodified polyester resin (ii) preferably has an acid value of from 1 to 5 mgKOH/g, and more preferably from 2 to 4 mgKOH/g. When a wax having a high acid value is used as a release agent, a binder resin having a low acid value is preferably used as the binder resin to impart good charging ability and high resistivity to the resultant toner.

The binder resin in the toner of the present invention preferably has a glass transition temperature (Tg) of from 40 to 70° C. and more preferably from 55 to 65° C. When the glass transition temperature is too low, the preservability of the toner deteriorates. In contrast, when the glass transition temperature is too high, the low temperature fixability deteriorates. When the toner of the present invention includes a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners.

Suitable colorants for use in the toner of the present invention include known dyes and pigments. Specific examples of the colorants include carbon black, Nigrosine dyes, black iron oxide, Naphthol Yellow S (C.I. 10316), Hansa Yellow 10G (C.I. 11710), Hansa Yellow 5G (C.I. 11660), HansaYellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), Permanent Red FRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flashing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

The organic solvent for use in dissolving or dispersing the toner constituent mixture is preferably volatile and has a boiling point lower than 150° C. so as to be easily removed from the resultant dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination.

The urea-modified polyester resins (UMPE) which is one of the modified polyester resins for use as the binder resin of the toner of the present invention can be prepared by reacting a polyester prepolymer (A) having an isocyanate group with an amine (B) in an aqueous medium.

In order to prepare a stable dispersion in which a toner constituent mixture liquid including a modified polyester resin or a prepolymer (A) is dispersed in an aqueous medium, the mixture liquid is dispersed in the aqueous medium upon application of shearing force thereto. The binder resins (optionally including an unmodified polyester resin) and other toner constituents such as colorants, colorant masterbatches, release agents, etc. are previously dissolved or dispersed in an organic solvent to prepare a toner constituent mixture liquid. Then the toner constituent mixture liquid is dispersed in an aqueous medium.

Suitable aqueous media for use in the toner manufacturing method of the present invention include water and mixtures of water and a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

The method for preparing the emulsion is not particularly limited, and any known methods such as low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. At this point, the particle diameter (2 to 20 μm) means a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes for a batch production method. The temperature in the dispersion process is typically from 0 to 150° C. (under pressure), and preferably from 40 to 98° C. When the dispersion is performed at a relatively high temperature, the dispersion including a prepolymer (A) or a urea-modified polyester resin has a low viscosity and therefore the dispersing operation can be easily performed.

When the emulsion is prepared, the weight ratio (T/M) of the composition (T) (including a prepolymer (A) or modified polyester resin) to the aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant toner particles do not have a desired particle diameter. In contrast, when the ratio is too small, the manufacturing costs increase.

When the emulsion is prepared, a dispersant can be preferably used so that particles in the emulsion have a sharp particle diameter distribution and the emulsion has good dispersion stability.

Suitable materials for use as the dispersant include particulate dispersants such as particulate inorganic dispersants and particulate polymer dispersants. In addition, known surfactants can be used in combination with the particulate dispersants.

Specific examples of the particulate inorganic dispersants include inorganic dispersants, which are hardly soluble in water, such as tricalcium phosphate, calcium carbonate, titanium oxide, colloidal silica, and hydroxyapatite can also be used.

Specific examples of the particulate polymers include particulate methyl methacrylate having a particle diameter of 1 μm or 3 μm, particulate polystyrene having a particle diameter of 0.5 μm or 2 μm, particulate styrene-acrylonitrile copolymers having a particle diameter of 1 μm (e.g., PB-200H from Kao Corp., SPG from Soken Chemical & Engineering Co., Ltd., TECHNOPOLYMER SB from Sekisui Plastic Co., Ltd., SGP-3G from Soken Chemical & Engineering Co., Ltd., and MICROPEARL from Sekisui Chemical Co., Ltd.)

Further, it is possible to stably disperse (emulsify) a toner constituents in water using a combination of the above-mentioned particulate dispersant (such as particulate inorganic dispersants and particulate polymers) with a polymeric protection colloid. Specific examples of such protection colloids include polymers and copolymers obtained from monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Specific examples of known surfactants which can be used in combination with the above-mentioned particulate dispersants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternaryammoniumsalts (e.g., alkyltrimethylammoniumsalts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl) glycin, di)octylaminoethyle)glycin, and N-alkyl-N,N-dimethylammonium betaine.

By using a surfactant having a fluoroalkyl group, a dispersion having good dispersibility can be prepared even when the amount of the surfactant is small. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6–C11)oxy}-1-alkyl(C3–C4) sulfonate, sodium 3-{omega-fluoroalkanoyl(C6–C8)-N-ethylamino}-1-propanesulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10)sulfoneamidepropyltrimethylammonium salts, salts of perfluoroalkyl(C6–C10)-N-ethylsulfonyl glycin, monoperfluoroalkyl(C6–C16)ethylphosphates, etc.

Specific examples of the marketed products of such surfactants include SARFRON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase liquid including toner constituents in water, include primary, secondary and tertiary aliphatic amines having a fluoroalkyl group, aliphatic quaternary ammonium salts such as perfluoroalkyl(C6–C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In order to decrease the viscosity of the emulsion including a toner constituent mixture liquid, a solvent which can dissolve the polyester resins serving as the binder resin is preferably used for the toner constituent mixture liquid. In this case, the resultant toner particles have a sharp particle diameter distribution.

The solvent is preferably volatile and has a boiling point lower than 100° C. so as to be easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; andhalogenated hydrocarbons such as methylene chloride, 1,2-dichloroethane, chloroform, and carbon tetrachloride are preferably used.

The added amount of such a solvent is from 0 to 300 parts by weight, preferably from 0 to 100 and more preferably from 25 to 70 parts by weight, per 100 parts by weight of the polyester (the prepolymer (A) or the urea-modified polyester) used.

The reaction time of elongation and/or crosslinking is determined depending on the reacting property of the prepolymer (A) and the amine (B) used, but the reaction time is generally from 10 minutes to 40 hours, and preferably 2 hours to 24 hours. The reaction temperature is generally from 0 to 150° C. and preferably from 40 to 98° C. In addition, a known catalyst can be optionally used. Specific examples of the catalyst include dibutyltin laurate and dioctyltin laurate.

In the toner manufacturing method of the present invention, the toner-shape controlling operation is performed in the solvent removing process in which the solvent is removed from the dispersion which has been subjected to an elongation reaction and/or a crosslinking reaction.

The solvent removing operation is typically performed by a batch method or a continues method.

One typical batch method is as follows. The system (i.e., the dispersion) is gradually heated to remove the solvent therein while agitated so as to form a laminar flow. Then, at a specific temperature range, the dispersion is agitated while applying a high shearing force thereto to deform the drops in the dispersion. By removing the solvent in the dispersion by this method, toner particles having a spindle form can be prepared.

The continuous method is performed by, for example, a device (such as continuous defoaming devices) which can continuously apply a shearing force to a dispersion and remove the solvent therein at the same time. By using such a method, toner particles having a spindle form can be prepared.

When compounds such as calcium phosphate, which are soluble in an acid or alkali, are used as a dispersant, the resultant toner particles are preferably added into an acid such as hydrochloric acid, followed by washing with water to remove calcium phosphate from the toner particles. In addition, calcium phosphate can be removed using a zymolytic method. The dispersant may be removed or may not be removed from the resultant toner particles. However, it is preferable to remove the dispersant by washing after the elongation and/or crosslinking reaction because the resultant toner has good charging properties.

The toner particle form can be controlled by changing the solvent removing conditions. In order to prepare toner particles having a desired particle form, it is important that a proper dispersant is used and in addition the solvent-removing conditions are properly controlled. When it is desired to form a recessed portion (or asperity) having a proper size on toner particles, the content of the solid components in the oil phase of the emulsion is preferably controlled to be from 5 to 50% by weight based on total weight of the oil phase. In addition, it is preferable that the solvent-removing temperature is controlled to be from 10 to 50° C., and the solvent-removing time is not greater than 30 minutes. When the solvent-removing treatment is performed under such conditions, the solvent in the oil phase is rapidly evaporated and thereby the temperature of the oil phase decreases, resulting in formation of a hard oil phase and shrinkage of the oil phase. Therefore, toner particles having a recessed portion (or asperity) can be prepared.

When the content of the solid components in the oil phase is too high (i.e., the amount of solvent in the oil phase is small), toner particles having a desired particle form are hardly obtained. In contrast, when the content of the solid components in the oil phase is too low, the productivity of the toner particles seriously deteriorates. When the solvent-removing time is too long, spherical particles tend to be obtained.

The solvent-removing conditions are not limited to the above-mentioned conditions, and it is preferable to optimize, for example, the temperature and solvent removing time.

An embodiment of the batch solvent removing method will be explained. FIG. 1 illustrates a dispersing device for use in the batch solvent removing method using a solvent removing tank. In FIG. 1, numerals 203, 206, 207, 208 and 209 denote a vacuum pump, a nitrogen supplying tube, a heat exchanger, a solvent removing tank and an agitator.

An emulsion (E), which has been subjected to an elongation reaction and/or a crosslinking reaction, is contained in the solvent removing tank 208 whichhas noprojection such asbuffle plates on the inner surface thereof. The emulsion (E) is agitated at a temperature of from 30 to 50° C. by the agitator 209 which applies a high shearing force to the emulsion (E) In this case, the dispersed particles in the emulsion are observed to determine whether the particles have a desired form (i.e., a spindle form). When it is confirmed that the particles have a desired form, the emulsion is subjected to a solvent removing treatment at a temperature of from 10 to 50° C. At this time, it is preferable that the pressure in the solvent removing tank 208 is controlled so as to be less than 101.3 kPa (i.e., 1 atm) using the vacuum pump 203 while supplying an inert gas such as nitrogen gas from the tube 206 to control the evaporating speed of the solvent to be removed.

The conditions are not limited to the above-mentioned conditions. However, it is important to apply a high shearing force to the emulsion which has been subjected to an elongation reaction and/or a crosslinking reaction, in order to prepare toner particles having a spindle form. This is because the emulsion which has a low viscosity due to addition of a solvent such as ethyl acetate in the granulation process receives a high shearing force, and thereby the shape of the particles is changed from a spherical form to a spindle form.

Thus, the volume average particle diameter Dv and the number average particle diameter Dn of the resultant toner particles, and the ratio Dv/Dn can be controlled by adjusting, for example, the viscosities of the water phase and the oil phase, and the properties and the added amount of the particulate dispersant used.

It is preferable to use a continuous solvent removing method using a continuous vacuum defoaming device, BUBBLE BUSTER® from Ashizawa Fine Tech Co., Ltd. An emulsion can be continuously supplied to the machine in which a bowl is rotated and the emulsion supplied to the bowl forms a thin layer while the internal pressure is reduced. Therefore, all the particles can receive uniform shearing force. By using this device, the effects of the present invention can be further enhanced. In order to change/control the evaporation speed of the solvent to be removed, it is preferable that the pressure in the vessel is controlled so as to be less than 101.3 kPa (normal pressure) and an inert gas is supplied to the vessel. By forming thin layer of the emulsion using the rotator such as bowls, the solvent can be efficiently removed from the emulsion. The internal pressure is preferably from 1 to 40 kPa. Gasses such as Argon, helium, nitrogen and neon can be used as the inert gas. Among these gasses, nitrogen gas is preferably used in view of cost and handling.

It is preferable to supply an inert gas in an amount of from 0.1 to 70% by volume, and preferably from 1 to 50% by volume, based on the volume of the emulsion to be treated. In addition, the peripheral velocity of the rotator, which is used to form a thin layer of the emulsion, is from 10 to 60 m/sec, and preferably from 20 to 50 m/sec.

The solvent removing treatment using the continuous vacuum defoaming device will be explained in detail referring to FIG. 2.

Figure 2:
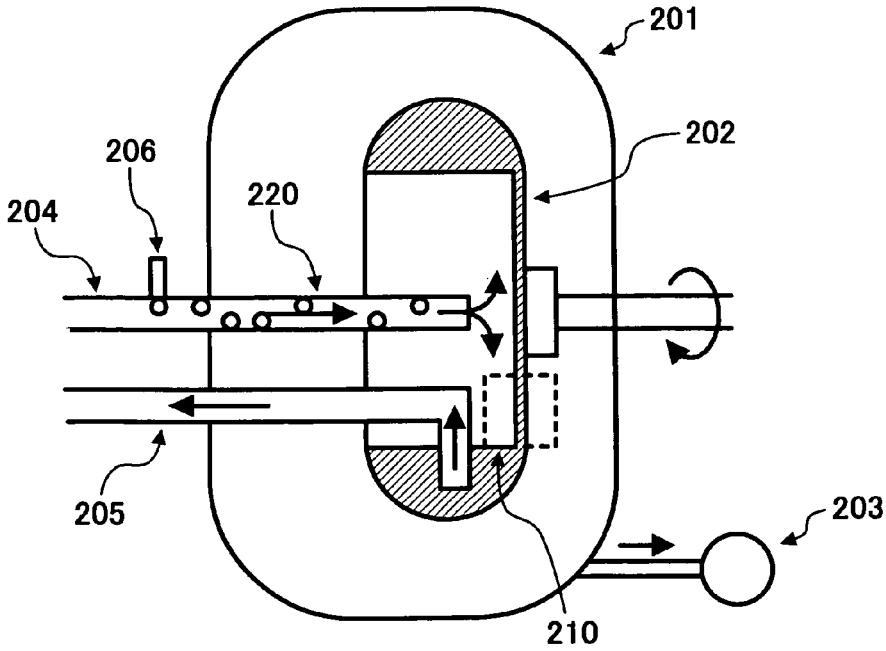
FIG. 2 is a schematic view illustrating a continuous vacuum defoaming device for use in controlling the shape of the toner of the present invention.

FIG. 2 is a schematic view illustrating the continuous vacuum defoaming device. The container 201 is decompressed by a vacuum pump 203 so that the internal pressure becomes a predetermined pressure. A rotating bowl 202 rotates in a direction indicated by an arrow so that the outermost end portion of the bowl 202 has a predetermined peripheral speed. An emulsion to be treated is automatically injected from a nozzle 204 to the inside of the rotating bowl 202 due to difference in pressure between the inside and outside of the container 201. At this point, nitrogen gas is supplied from a nozzle 206 into the emulsion and thereby bubbles 220 of nitrogen gas are formed in the emulsion.

The thus injected dispersion including nitrogen gas bubbles 220 therein is moved toward the outer portion of the rotating bowl 202 along an inner wall 210 of the rotating bowl 202 due to a centrifugal force while forming a thin layer. At this point, the emulsion receives a strong shearing force and in addition the solvent in the emulsion easily evaporates because the emulsion becomes a thin layer and the pressure inside the container 201 is reduced. In addition, since the nitrogen gas bubbles 220 are included in the emulsion, the solvent in the emulsion can be efficiently evaporated. The particles in the emulsion moved to the outer portion is solidified because the solvent therein is evaporated. The thus prepared dispersion is discharged from an exit 205 due to a centrifugal force.

Figure 3A:
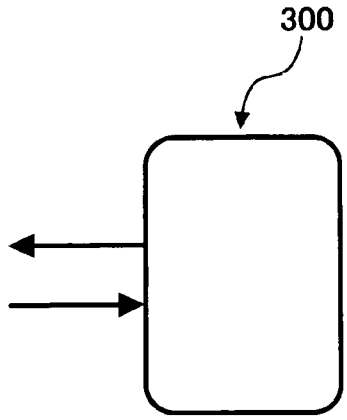
FIGS. 3A and 3B are schematic views illustrating examples of how the continuous vacuum defoaming device is used.
Figure 3B:
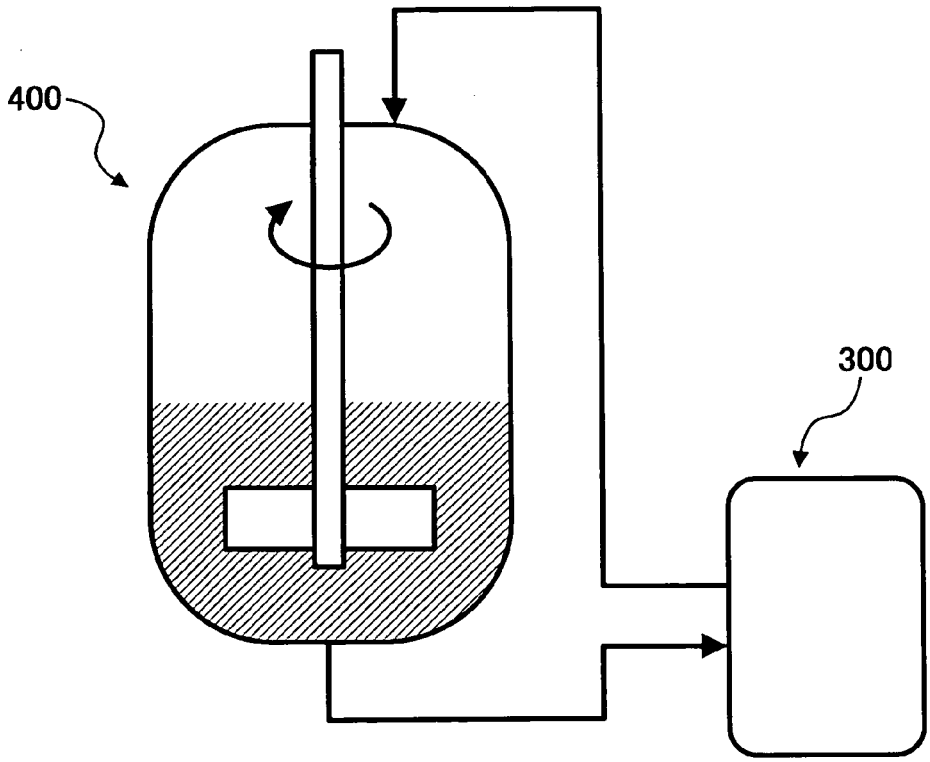

FIGS. 3A and 3B illustrate embodiments of the solvent removing device for use in the toner manufacturing method of the present invention. FIG. 3A illustrates an embodiment of the one-pass continuous solvent removing device, and FIG. 3B illustrates an embodiment of the batch-type continuous solvent removing device. In FIGS. 3A and 3B, numeral 300 denotes a continuous vacuum defoaming device, and numeral 400 denotes a service tank having a stirrer.

Figure 4A:
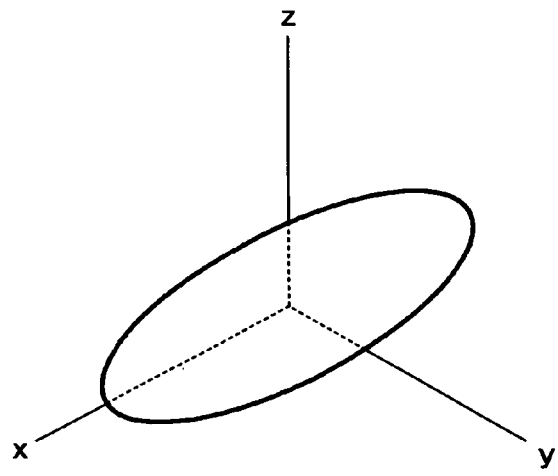
FIGS. 4A to 4C are schematic views illustrating an embodiment of a particle of the toner of the present invention and for explaining the parameters r1, r2 and r3.
Figure 4B:
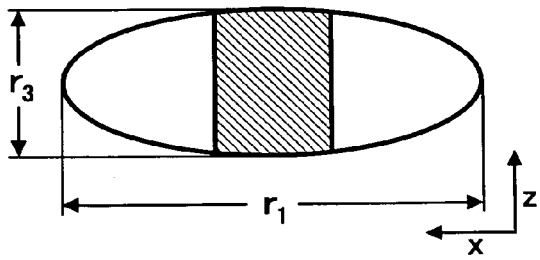
Figure 4C:
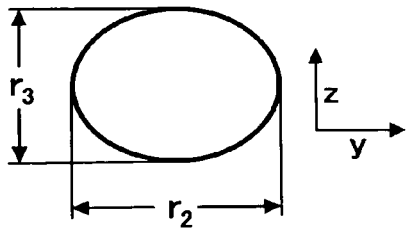

It is preferable for the thus prepared toner to have a spindle form and an average particle diameter of from 3 to 8 μm. FIGS. 4A–4C are schematic views illustrating an example of a particle of the toner of the present invention. FIG. 4A is a perspective view of the toner particle, and FIGS. 4B and 4C are cross sections of the toner particle.

In FIG. 4A, the toner particle has a major axis particle diameter r1 in an X direction, a minor axis particle diameter r2 in a Y direction and a thickness r3 in a Z direction. In this regard, the following relationship is satisfied:

$$r1>r2>r3.$$

Since the smaller the volume average particle diameter (Dv) of a toner, the better the fine dot (line) reproducibility of the toner images, the volume average particle diameter (Dv) is preferably not greater than 8 μm. However, the smaller the volume average particle diameter (Dv) of a toner, the worse the cleanabililty of the toner, and therefore the volume average particle diameter (Dv) is preferably not less than 3 μm. In particular, when toner particles having a particle diameter not greater than 2 μm are included in the toner in an amount not less than 20%, such fine toner particles tend to be present on the surface of the carrier and the developing roller used, and thereby the other toner particles are insufficiently contacted and frictionized with the carrier and the developing roller, resulting in increase of the amount of reversely charge toner particles. Therefore, background development occurs and image qualities deteriorate.

In addition, the ratio (Dv/Dn) (i.e., anindexofparticle diameter distribution) of the volume average particle diameter (Dv) to the number average particle diameter (Dn) of the toner is preferably from 1.00 to 1.40. When the toner has a sharp particle diameter distribution, the toner particles have uniform charge quantities (i.e., the toner has a sharp charge quantity distribution), and thereby occurrence of background development can be prevented.

When the ratio (Dv/Dn) is too large, the toner has broad charge quantity distribution, and thereby it becomes difficult to produce high quality images.

The particle diameters Dv and Dn of a toner can be measured by a COULTER COUNTER MULTISIZER (manufactured by Beckman Coulter, Inc.) using an aperture having an opening of 50 μm. The average particle diameters Dv and Dn are determined by measuring 5,000 particles and averaging the data.

The shape of the toner particles can be controlled by controlling the manufacturing conditions. When a toner is prepared by a dry pulverization method, the surface of the resultant toner particles are roughened (i.e., the surface has projected portions and recessed portions), namely, the toner particles have irregular forms. By subjecting such toner particles as prepared by a pulverization method to a mechanical treatment or a heat treatment, the shape of the toner particles can be changed to a form near the spherical form.

Toner particles prepared by a wet polymerization method such as suspension polymerization methods and emulsion polymerization methods have smooth surface and a form near the spherical form. In addition, it is possible to form toner particles having an irregular form like potato by at first preparing fine toner particles and then agglomerating the fine toner particles. Further, it is possible to form toner particles having an ellipse form or a flat form by preparing toner particles by a polymerization method and applying a shearing force to the toner particles in process of the polymerization reaction.

Toners prepared by wet polymerization methods have poor cleaninability. For example, even when such toners have an average particle diameter of about 10 μm, the cleaning problem mentioned above often occurs if a blade is used as a cleaner. This is because the surface of the toner particles is smooth and thereby the toner tends to roll on the surface of a photoreceptor and invades into a gap between the cleaning blade and the photoreceptor. In addition, there are no projections and recessed portions on the surface of such spherical toners, and therefore all the particles of the external additive (such as silica) included in the toner are contacted with the surface of a photoreceptor.

A large amount of external additive (such as silica) is typically added to a spherical toner, but the external additive tends to be embedded into the toner, resulting in occurrence of fusion of the toner particles and thereby undesired streak images are formed.

In contrast, toners having an irregular form have many projections and recessed portions on the surface thereof. Therefore the toner particles hardly roll on the surface of a photoreceptor, and thereby the toner particles on the surface of a photoreceptor can be easily removed by a cleaning blade.

A toner having a spindle form easily rolls in only one direction. Namely, the toner rotates on its major axis (i.e., the X direction in FIG. 1A). Therefore the toner has good cleanability. In addition, when the toner has a projection at an end thereof in its major axis direction, the center of gravity deviates from the center of the spindle portion, and thereby the toner particles make irregular movement, resulting in further improvement of the cleanability of the toner.

In addition, when a toner image is transferred by an electrostatic transfer method, the toner image is well transferred on a receiving material if the toner is a spherical toner. This is because spherical toner particles have good fluidity and small adhesion to each other or to a photoreceptor because of having smooth surface, and thereby the toner particles are easily influenced by electric forces. Therefore a toner image can be faithfully transferred along the electric lines of force. However, when a receiving material is separated from a photoreceptor after the toner image transfer process, a high electric field is generated between the receiving material and thephotoreceptor (so-called "aburst phenomenon") Therefore, the toner image on the receiving material tends to be scattered, resulting in formation of toner scattering. In this case, when the toner image is formed of spherical toner particles, the toner image is easily scattered, and thereby a serious toner scattering problem is caused, resulting in deterioration of the image qualities.

Toner particles having an irregular form or a flat form are not so strongly influenced by electric force as the spherical toner particles. Namely, such toner particles have a low transfer rate. However, the toner particles have large adhesion to each other, and thereby a toner image transferred on a receiving material is hardly damaged by an external force. Therefore, the toner scattering problem due to the burst phenomenon can be avoided.

The toner of the present invention having a spindle form has a proper fluidity because of having a good rolling property in one direction, and has a smooth surface. Therefore, the toner is easily influenced by electric force, and thereby the toner image can be faithfully transferred at a high transfer rate along the electric lines of force. In addition, since the toner has only one rolling direction, the toner hardly causes the toner scattering problem due to the burst phenomenon because the toner particles are hardly scattered. Therefore, good images can be produced.

When an electrostatic latent image is developed with a toner by an electrostatic developing method, the latent image is faithfully developed along the electric lines of force if the toner is formed of spherical toner particles because the toner easily influenced by electric force. In particular, when a fine latent image is developed with a toner and the toner image is transferred, the toner image has good dot reproducibility if the toner is a spherical toner. This is because spherical toner particles are densely arranged in the toner image.

However, a latent image is developed by a contact developing method, the toner adhered to the latent image is easily moved by being further rubbed with a magnet brush or a developing roller, and thereby the toner scattering problem occurs, resulting in deterioration of the image qualities.

In contrast, toner particles having an irregular form or a flat form have poor fluidity, and therefore the toner particles cannot be moved along the electric force of an electrostatic latent image, and thereby the toner particles are not orderly arranged on the latent image. Namely, the resultant toner image has poor fine dot reproducibility.

The toner of the present invention having a spindle form has a properly controlled fluidity and is adhered to an electrostatic latent image along the electric lines of force. Therefore, the latent image can be faithfully developed by the toner, resulting in formation of a toner image having good dot reproduciblity. In addition, the toner in the developed image is hardly moved by a magnetic brush and a developing roller, and thereby high quality images can be produced without producing undesired images such as toner scattering.

The toner of the present invention preferably satisfies the following relationship:

$$0.5 \leqq (r2/r1) \leqq 0.8 \text{ and } 0.7 \leqq (r3/r2) \leqq 1.0.$$

When the ratio (r2/r1) is too small, the toner has a form far away from the spherical form, and therefore the toner has good cleanability, but the dot reproducibility and transfer efficiency deteriorate, resulting in deterioration of image qualities. In contrast, when the ration (r2/r1) is too large, the toner has a form near the spherical form and therefore the cleaning problem tends to occur, particularly, under low temperature and low humidity conditions.

When the ratio (r3/r2) is too small, the toner has a flat form and therefore the toner does not cause the toner scattering problem because of being similar to a toner having an irregular form. However, such a toner is inferior to a spherical toner in transferability. In particular, when the ratio (r3/r2) is 1.0, the toner easily rotates on its major axis. The toner of the present invention preferably has a spindle form which is different from the spherical, irregular and flat forms, and has all the advantages of the spherical-, irregular- and flat-form toners, i.e., good charging ability, good dot reproducibility, high transferability, good scatter-preventing ability and good cleanability.

The toner of the present invention preferably satisfies the following relationships:

5 μm≦average of major axis particle diameter r1≦9 μm;

2 μm≦average of minor axis particle diameter r2<6 μm; and

2 μm≦average of thickness r3≦6 μm; wherein r1>r2≧r3.

When the average major axis particle diameter r1 is too small, the cleanability of the toner deteriorates, and it becomes difficult to perform cleaning with a cleaning blade. In contrast, when the average major axis particle diameter is too large, there is a possibility that the toner is pulverized when the toner is mixed with a magnetic carrier. When the thus produced fine toner particles are adhered to amagnetic carrier, other toner particles are prevented from being frictionized by the carrier, resulting in broadening of the charge quantity distribution of the toner. Therefore, background development is caused. The above-mentioned pulverizing is performed by a developing roller as well as a magnetic carrier.

When the average minor axis particle diameter r2 is too small, the resultant toner has poor fine dot reproducibility and low transfer rate (i.e., poor transferability). In addition, such a toner tends to be easily pulverized when mixed with a magnetic carrier. In contrast, when the average minor axis particle diameter r2 is too large, the cleanability of the toner deteriorates and it becomes difficult to perform cleaning with a cleaning blade.

When the thickness r3 is less than 2 μm, the toner tends to be easily pulverized when mixed with a magnetic carrier. When the thickness is greater than 6 μm, the toner has a form near the spherical form and therefore the toner scattering problem tends to occur when the toner is used for electrostatic developing methods and electrostatic transferring methods.

In addition, the toner of the present invention preferably satisfies the following relationships:

(1) Standard deviation S1 of major axis particle diameter r1: not greater than 2.0 μm;
(2) Standard deviation S2 of minor axis particle diameter r2: not greater than 1.5 μm; and
(3) Standard deviation S3 of thickness r3: not greater than 1.5 μm.

When the standard deviations S1, S2 and S3 are too large (i.e., the toner has variation in it form), there are many variations in the behavior of the toner during developing, transferring and cleaning processes, resulting in deterioration of the image qualities.

It is preferable for the toner of the present invention to include toner particles having a thickness r3 not greater than 3 μm in an amount not greater than 30% by weight based on the total weight of the toner. When the content of toner particles having a thickness not greater than 3 μm is too high, the toner is similar to a flat toner, and therefore fine dot reproducibility and transferability of the toner deteriorate.

The above-mentioned size factors (i.e., r1, r2, r3, S1, S2 and S3) of toner particles can be determined by observing the toner particles with a scanning electron microscope while the viewing angle is changed.

The toner of the present invention preferably has a form factor SF-2 of from 100 to 190. The form factor represents the degree of the asperity of the surface of a toner particle, and is defined by the following equation (1):

$$SF\text{-}2=\{(\mathrm{PERI})^2/\mathrm{AREA}\}\times(100\pi/4) \quad (1)$$

wherein PERI and AREA represent the peripheral length and area of a toner particle, respectively.

A toner having a form factor of 100 has no asperity on the surface thereof. Toners having a large form factor have a roughened surface, and thereby the toners cannot be uniformly charged, resulting in deterioration of the image qualities (i.e., occurrence of background development). Therefore the form factor is preferably not greater than 190.

The form factor SF-2 can be determined by the following method:

(1) toner particles are observed with a FE-SEM S-800 manufactured by Hitachi Ltd. with magnification power of 500; and
(2) 100 pieces of the particle images caught by the SEM, which are randomly sampled, are analyzed with an image analyzer LUZEX III manufactured by Nireco Corp. using an interface.

It is preferable that a material (hereinafter this material is referred to as a protective material) which protects the surface of the toner of the present invention is fixed on the surface of the toner. As mentioned above, the toner of the present invention has a spindle form and thereby the toner particles easily rotate on the major axis thereof (i.e., the X axis in FIG. 4A). Therefore, the toner particles rotate on the surface of the carrier, the developing roller and the photoreceptor, wherein the major axis thereof is a rotation axis. Therefore, the portion of a toner particle illustrated as a shadow area in FIG. 4B tends to be damaged. Specifically, a problem occurs in that a soft material such as waxes exude from the portion, and thereby the carrier, developing roller and photoreceptor are contaminated with the soft material. Therefore it is preferable to protect the surface of the toner.

Specific examples of the protective material include hard materials, for example, carbides such as boron carbide, silicon carbide, titanium carbide, zirconium carbide and tungsten carbide; and nitrides such as titanium nitride, boron nitride and zirconium nitride. The protective material is preferably fixed on the surface of the toner to prevent the protective material from releasing from the toner surface and to prevent the released protective material from adhering to or damaging the surface of the carrier, developing roller, photoreceptor and charger. Therefore, the protective material is preferably fixed on the toner surface upon application of strong external force using a mixer, etc.

In addition, charge controlling agents can be used as the protective material. In this case, the charge controlling agents not only protect the toner surface but also impart good friction chargeability to the toner. The charge controlling agents can be used in combination with the hard materials mentioned above.

It is preferable that a protective material is fixed on the toner surface by a mechanical or heat treatment in the atmosphere. When the toner is prepared by a wet polymerization process, it is also preferable to fix a protective material on the toner surface by performing an electrochemical or mechanical treatment in a solvent during the wet polymerization process.

Specifically, the following fixing methods can be preferably used:

(1) Toner particles and a protective material are mixed in a container using a mixer having a rotator. When using this method, it is preferable that toner particles and a protective material are mixed in a container having no projection therein while a rotator is rotated at a high speed, to fix the protective material on the toner surface.

(2) Toner particles and a protective material are preliminarily mixed. Then the mixture is sprayed into a container by an atomizer or the like using hot air, followed by cooling. Thus, the protective material is fixed on a melted surface of the toner particles.

(3) A method in which a protective material is adsorbed on the surface of toner particles in a solvent can also be used.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and it compounds, tungsten and its compounds, fluorine-containing activators, metal salts of salicylic acid, metal salts of salicylic acid derivatives, etc.

Specific examples of the charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; metal salts (such as Cr, Zn, Fe, Zr, and Al) of salicylic acid and their complexes and complex salts; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner is preferably from 0.2 to 2.0% by weight, preferably from 0.3 to 1.5% by weight and more preferably from 0.4 to 1.0% by weight, based on the total weight of the toner. The charge controlling agent can be fixed on the toner surface by being mixed with toner particles while agitating. Whether a charge controlling agent is present on the surface of a toner can be determined by X-ray photoelectron spectroscopy. It is preferable to use a charge controlling agent having the same charge polarity as that of the toner particles. By using such a charge controlling agent, the resultant toner has not only quick charging property but also a narrow charge quantity distribution, and thereby high quality images can be produced without causing background development even after toner is replenished.

When the content of the charge controlling agent is too high, the amount of toner particles having an opposite polarity increases due to friction charging of the toner particles themselves, resulting in occurrence of background development. In addition, when toner particles have a large charge quantity, the fluidity of the toner deteriorates, and thereby the mixing property of the toner with a carrier deteriorates. In contrast, the content of the charge controlling agent is too low, weakly charged toner particles increase, resulting in occurrence of background development. In addition, when the toner is used for a long period of time, the chargeability of the toner deteriorates, resulting in occurrence of background development and deterioration of the image qualities.

The toner of the present invention having a spindle form has a surface which is relatively smooth compared to that of toners having an irregular or flat form because the toner surface is similar to that of the spherical toners, and has good charging properties such that charging quantity is relatively uniform and charge quantity distribution is relatively narrow compared to those of toners having an irregular or flat form. In addition, since the toner has good mixability with a carrier, the toner has good charge rising property, which is an important requisite of a toner for use in a developing method in which developing is performed while replenishing the toner. Therefore occurrence of background development can be avoided. Needless to say, the same is true for a one component developer including the toner of the present invention.

The toner of the present invention includes a binder resin, a colorant and a release agent. The release agent is present in a surface portion of the toner particles. In addition, a charge controlling agent and a particulate organic material are fixed on the surface of the toner of the present invention. Further, an external additive is present on the surface of the toner particles.

It is preferable for the toner of the present invention that the release agent is included in a surface portion of the toner particles while achieving a proper dispersed state. This is because the release agent causes a negative adsorption on the polar group in the modified polyester resin at the interface therebetween (i.e., the release agent is adsorbed on the polar group but is not mixed with the polar group), and thereby the release agent can be stably dispersed in the toner particles. In particular, when a toner is prepared by dissolving or dispersing a toner composition in an organic solvent, and then dispersing the toner composition liquid in an aqueous medium, the bonding portion of the binder resin, which has a high polarity, migrates to the surface portion of toner particles because of having fair affinity for water, and thereby the toner particles can be prevented from exposing the release agent.

It is preferable that the release agent is present in a surface portion of toner particles in an amount not less than 80% by number based on total particles of the release agent included in the toner particles. In such a toner, a sufficient amount of releasing agent can exude from the surface of the toner particles when toner images are fixed. Therefore, this toner can be used for oil-less fixing methods. In addition, even when this toner is used for an oil-less fixing method, the toner can produce (color) images having high gloss. Since the release agent is hardly present on the toner surface, the toner has good durability and preservability.

Specifically, when the ratio of the release agent included in the cross section of a surface portion (from 0 to 1 μm in depth) of toner particles is preferably from 5 to 40% based on total area of the cross section of the surface portion. When the ratio is to small, the toner has poor offset resistance. In contrast, when the content is too large, the toner has poor heat resistance and durability. In this regard, the surface portion is defined as a surface portion having a thickness of 1 μm (i.e., a portion having a depth up to 1 μm from the surface of the toner particles).

The release agent dispersed in the toner particles preferably has a particle diameter distribution such that particles having a particle diameter of from 0.1 to 3 μm are present in an amount not less than 70% by number, and more preferably particles having a particle diameter of from 1 to 2 μm are present in an amount not less than 70% by number. When the content of fine particles is too high, good release property cannot be imparted to the toner. In contrast, when the content of large particles is too high, the toner has poor fluidity because the release agents agglomerate, resulting in formation of a film of the release agent on a photoreceptor, etc. In addition, when such a toner is used as a color toner, the toner has poor color reproducibility and the toner images have a low gloss.

In order to control the dispersion state of the release agent in toner particles, it is important that the release agent is dispersed in a medium while the dispersion energy is properly controlled and a proper dispersant is added thereto.

It is preferable for the release agent to rapidly exude from the surface of the toner. When a release agent having too high an acid value is used, the resultant toner has poor releasability, and therefore the release agent for use in the toner of the present invention preferably has an acid value not greater than 5 mgKOH/g. From this point of view, carnauba waxes which are subjected to a free-fatty-acid removing treatment, rice waxes, montan ester waxes and ester waxes, which have an acid value not greater than 5 mgKOH/g, are preferably used as the release agent in the toner of the present invention.

In addition, it is preferable that an organic particulate material is fixed on the surface of the toner of the present invention to exude the release agent present in a surface portion from the surface of the toner only when the toner is heated to be fixed on a receiving material. When the toner has such a constitution, a problem in that the release agent included in the surface portion exudes from the surface of the toner when the toner is agitated in a developing device, resulting in deterioration of the chargeability of the toner, can be avoided.

In order to fix an organic particulate material on the surface of the toner, the following methods are preferably used, but the fixing method is not limited thereto:

(1) a particulate resin is adhered to the surface of toner particles and then heat is applied thereto to fix the particulate resin on the surface of the toner; or (2) a particulate resin is fixed on the surface of toner particles in a liquid.

Suitable materials for use as the particulate organic materials include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination. Among these resins, vinyl resins, polyurethane resins, epoxy resins, polyester resins and mixtures thereof are preferable because aqueous dispersion including small spherical resin particles can be easily prepared.

Specific examples of the vinyl resins include homopolymers or copolymers of vinyl monomers, such as styrene/(meth)acrylate copolymers, styrene-butadiene copolymers, (meth)acrylic acid/acrylate copolymers, styrene/acrylonitrile copolymers, styrene/maleic anhydride copolymers, styrene/(meth)acrylic acid copolymers, etc.

The toner of the present invention preferably includes an external additive to improve the fluidity, developability, chargeability thereof.

Inorganic fine particles are typically used as an external additive. Suitable inorganic fine particles include inorganic particulate materials having a primary particle diameter of from 5 nm to 2 μm, and preferably from 5 nm to 500 nm. The surface area of the inorganic particulate materials is preferably from 20 to 500 $m^2/g$ when measured by a BET method.

The content of the inorganic particulate material in the toner is preferably from 0.01% to 5.0% by weight, and more preferably from 0.01% to 2.0% by weight, based on the total weight of the toner.

Specific examples of such inorganic particulate materials include silica, titanium oxide, alumina, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particulate resins prepared by a method such as soap-free emulsion polymerization methods, suspension polymerization methods and dispersion polymerization methods can also be used as the external additive. Specific examples of the particulate resins include particles of polymers such as polystyrene resins and (meth)acrylate copolymers; polycondensation polymers such as silicone resins, benzoguanamine resins and nylons; and thermosetting polymers.

The external additive is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylation agents, silane coupling agents having a fluorinated alkyl group, organic titanate coupling agents, aluminum coupling agents, silicone oils, modified silicone oils, etc.

In addition, a cleanability improving agent can be included in the toner to impart good cleaning property to the toner, i.e., to easily remove toner particles, which remain on the surface of an image bearing member such as a photoreceptor even after a toner image is transferred, from the image bearing member. Specific examples of such a cleanability improving agent include fatty acids and their metal salts such as zinc stearate, and calcium stearate; and particulate polymers such as polymethyl methacrylate and polystyrene, which are manufactured by a method such as soap-free emulsion polymerization methods. The particulate polymers preferably has a volume average particle diameter of from 0.01 μm to 1 μm.

The toner of the present invention can be used for a two-component developer in which the toner is mixed with a magnetic carrier. The weight ratio (T/C) of the toner (T) to a carrier (C) is preferably from 1/100 to 10/100.

Suitable carriers for use in the two component developer include known carrier materials such as iron powders, ferrite powders, magnetite powders, and magnetic resin carriers, which have a particle diameter of from about 20 μm to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the coating resin. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant carrier.

The toner of the present invention can also be used as a one-component magnetic developer or a one-component non-magnetic developer, which does not use a carrier.

Then the image forming apparatus of the present invention will be explained referring to FIGS. 5 and 6.

Figure 5:
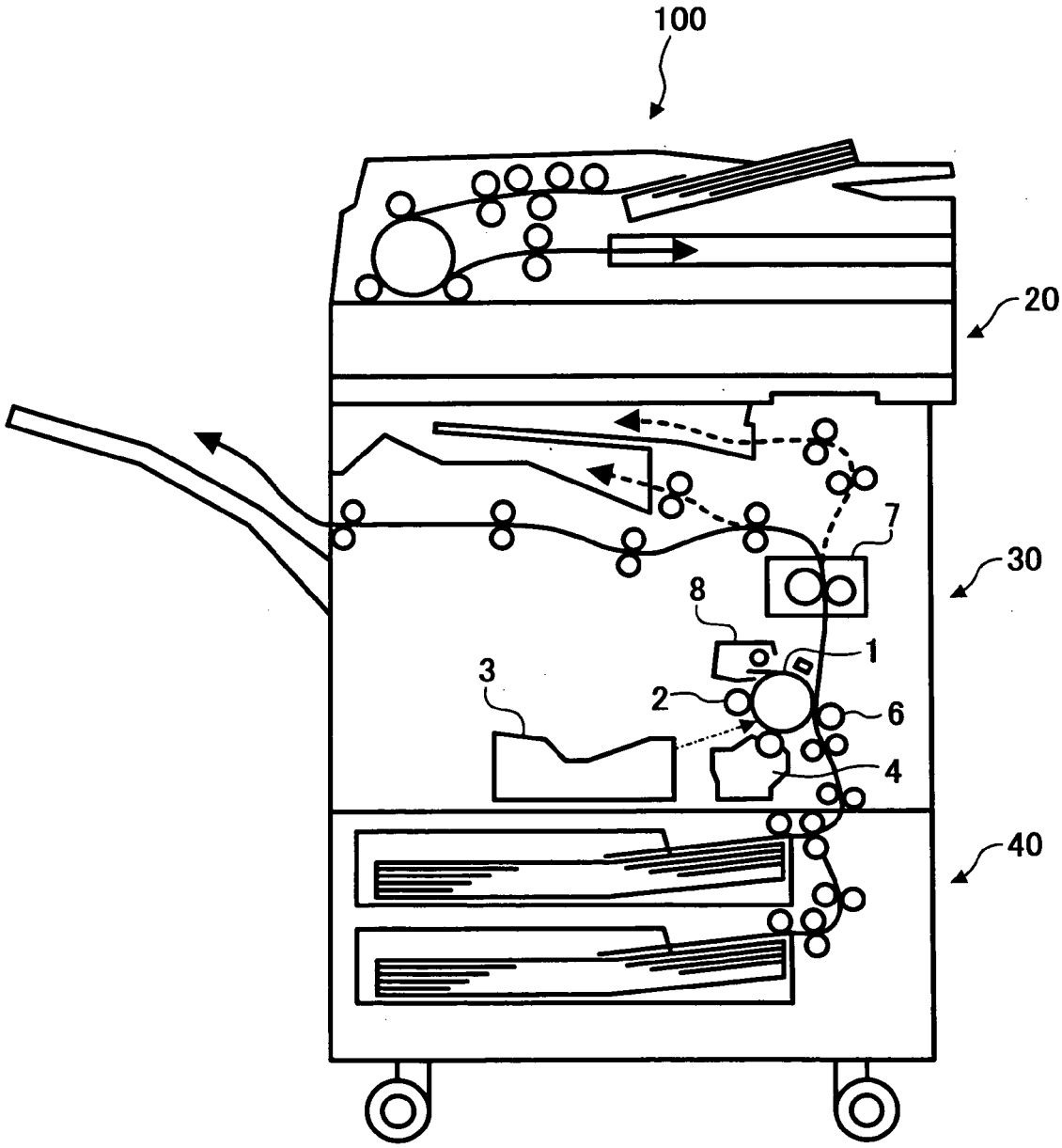
FIG. 5 is a schematic view illustrating an embodiment of the image forming apparatus of the present invention.

FIG. 5 is a schematic view illustrating the entire of an embodiment of the image forming apparatus of the present invention. FIG. 6 is a schematic view illustrating the image forming portion of the image forming apparatus illustrated in FIG. 5.

In FIG. 5, an image forming apparatus 100 (i.e., a copier) has an image reading unit 20 configured to read an image of an original, an image forming unit 30 configured to reproduce the original image, and a paper feeding unit 40 configured to feed a receiving material such as paper toward the image forming unit 30. The image forming unit 30 includes a photoreceptor 1, a charger 2 configured to charge the photoreceptor 1, a light irradiator 3 configured to irradiate the photoreceptor with light to form an electrostatic latent image, a developing device 4 configured to develop the electrostatic latent image with a developer including the toner of the present invention to form a toner image on the photoreceptor 1, and a transfer device 6 configured to transfer the toner image on the receiving material fed from the paper feeding unit 40. The toner image on the receiving material is fixed by a fixing device 7, resulting in formation of a hard copy. The copy is discharged on a paper tray. The surface of the photoreceptor 1 is cleaned by a cleaning device 8 after the image transfer process, so that the photoreceptor 1 is ready for the next image forming operations.

Figure 6:
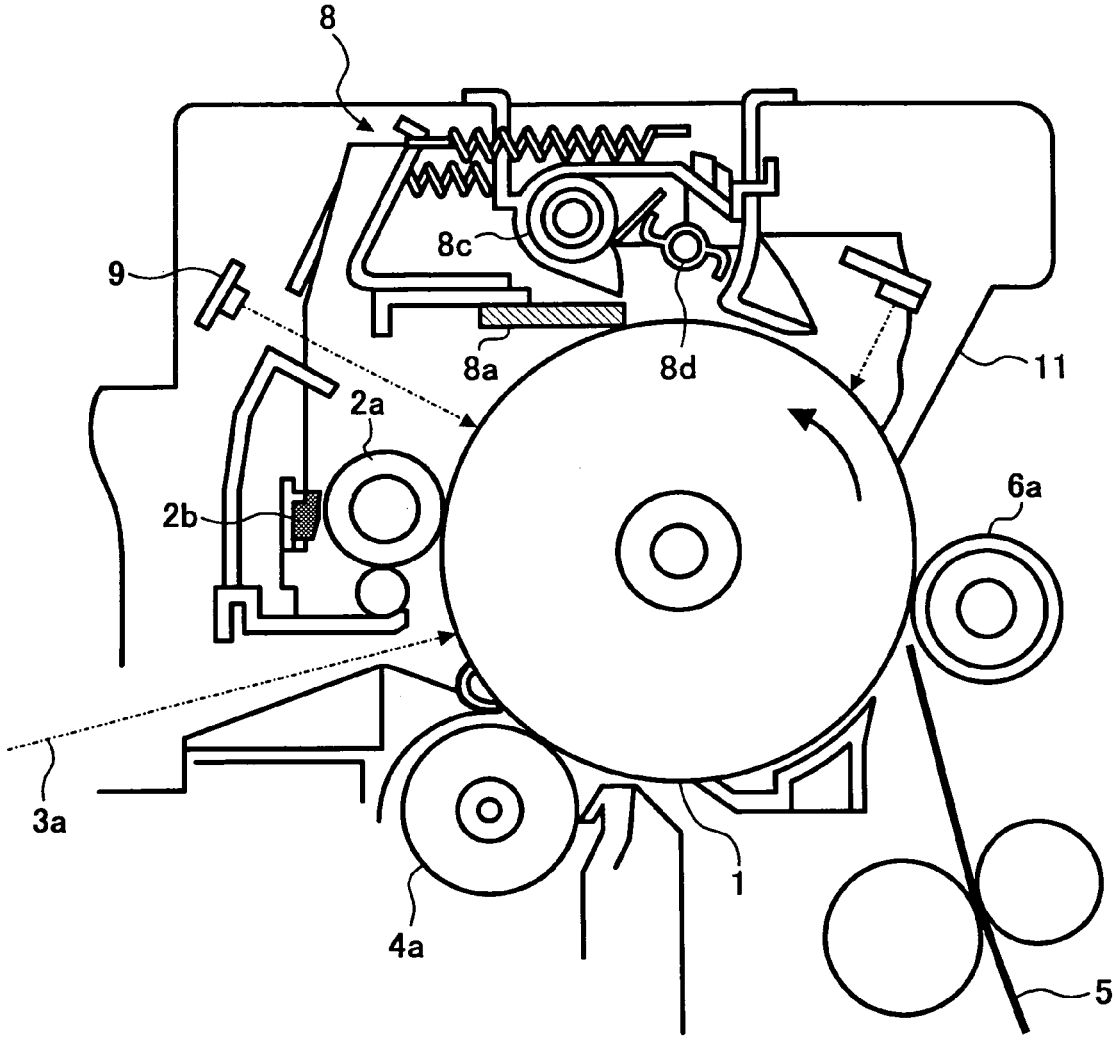
FIG. 6 is a schematic view illustrating the main portion of the image forming apparatus illustrated in FIG. 5.

The image forming operations will be further explained referring to FIG. 6.

The photoreceptor 1 rotates in a direction indicated by an arrow. At first, the surface of the photoreceptor 1 is entirely charged with a charging roller 2*a*. Numeral 2*b* denotes a temperature detector. Light 3*a* emitted from the light irradiating device 3 irradiates the charged photoreceptor 1 to form an electrostatic latent image on the surface of the photoreceptor 1. The electrostatic latent image on the photoreceptor 1 is developed with the toner in a developer layer formed on the surface of a developing roller 4*a* of the developing device 4. Thus, a toner image is formed on the surface of the photoreceptor 1. The toner image is transferred to a receiving material 5, which is fed from the paper feeding unit 40, at a nip between the photoreceptor 1 and a transfer roller 6*a* of the transfer device 6.

The receiving material 5, on which the toner image is transferred, is then separated from the photoreceptor 1 by a separation pick 11 to be conveyed to the fixing device 8. Then the surface of the photoreceptor 1 is cleaned by a cleaning blade 8*a* of the cleaning device 8. Numerals 8*c* and 8*d* denote a toner collecting coil and a toner collecting blade, which are used for collecting residual toner particles on the photoreceptor 1. Numeral 9 denotes a discharging lamp configured to discharge the charges remaining on the photoreceptor.

Figure 7:
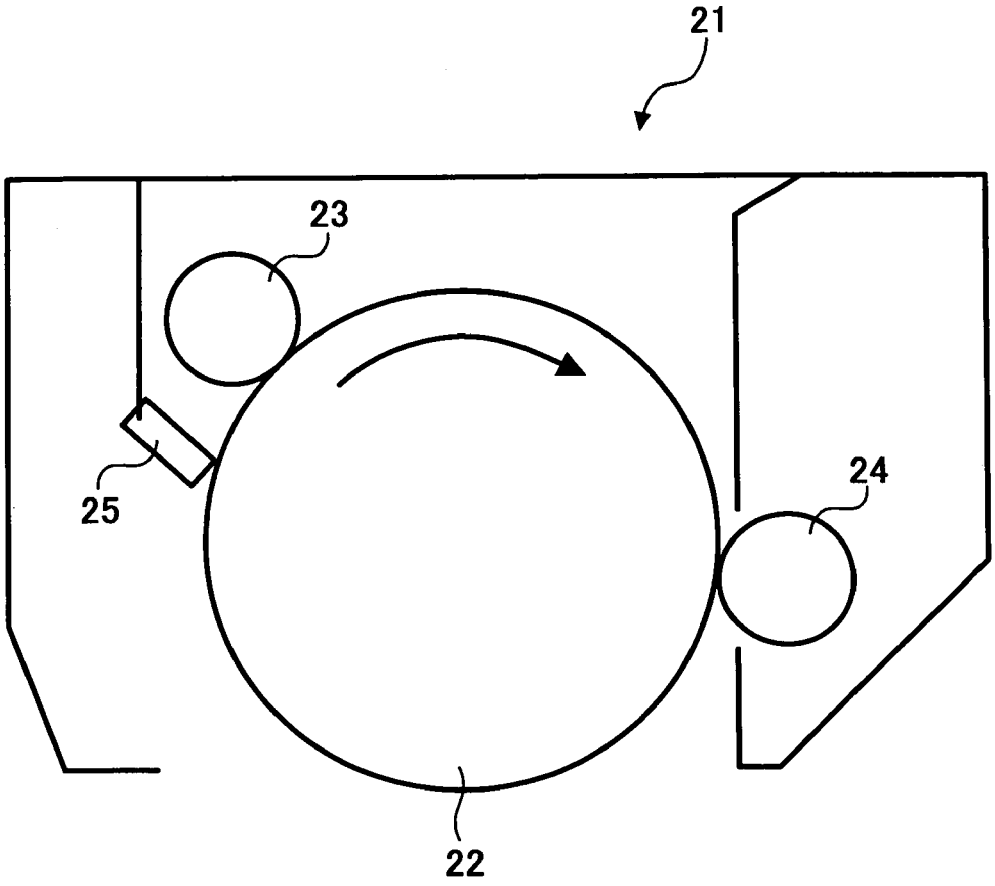
FIG. 7 is a schematic view illustrating an embodiment of the process cartridge of the present invention.

FIG. 7 is a schematic view illustrating the cross section of an embodiment of the process cartridge of the present invention. Numeral 21 denotes a process cartridge. The process cartridge 21 includes a photoreceptor 22 serving as an image bearing member bearing an electrostatic latent image thereon, a charger 23 which charges the photoreceptor 22, a developing roller 24 serving as a member of a developing device which develops the electrostatic latent image on the photoreceptor 22 with a developer including the toner of the present invention to form a toner image on the photoreceptor 22, and a cleaning blade 25 which serves as a cleaner and which removes toner particles remaining on the surface of the photoreceptor 22 after the toner image on the photoreceptor 22 is transferred onto a receiving material (not shown).

The process cartridge 21 is not limited to the process cartridge 1 illustrated in FIG. 7. Any process cartridges including at least an image bearing member and a developing device including the toner of the present invention can be used as the process cartridge of the present invention.

The process cartridge of the present invention is detachably set in an image forming apparatus. In the image forming apparatus in which the process cartridge is set, the photoreceptor 22 is rotated at a predetermined rotation speed in a direction indicated by an arrow. The photoreceptor 22 is charged with the charger 23 and thereby the photoreceptor 22 is uniformly charged positively or negatively. Then an image irradiating device (not shown) irradiates the charged surface of the photoreceptor 22 with light using a method such as slit irradiation methods and laser beam irradiation methods, resulting in formation of electrostatic latent image on the photoreceptor 22.

The thus prepared electrostatic latent image is developed by the developing roller 24 bearing a developer including the toner of the present invention thereon, resulting in formation of a toner image on the photoreceptor 22. The toner image is then transferred onto a receiving material (not shown) which is timely fed by a feeding device (not shown) to a transfer position between the photoreceptor 22 and a transfer device (not shown).

The toner image formed on the receiving material is then separated from the photoreceptor 22 and fixed by a heat/pressure fixing device (not shown) including a fixing roller. The fixed image is discharged from the image forming apparatus. Thus, a hard copy is produced.

The surface of the photoreceptor 22 is cleaned by the cleaning blade 25 to remove toner remaining on the photoreceptor 22, followed by discharging, to be ready for the next image forming operation.

Then the toner packing method and device of the present invention will be explained in detail. This toner packing method and device can be applied to not only toners but also other powders.

It is well known that a powder is transported while being fluidized pneumatically by being mixed with a gas. When a fine powder (such as toner, hereinafter referred to as toner) having a particle diameter not greater than 20 μm, particularly not greater than 10 μm, is contained in a container by merely discharging the toner into the container, a problem in that the powder is scattered around the container tends to occur. When this toner packing operation is performed in a factory, occurrence of the toner scattering problem can be prevented, for example, by using a gasifier or the like. However, it is not practical to set such a gasifier in an office.

Fine toner powders typically have a large surface area compared to their volume. Therefore, such fine toner powders typically aggregate. When such an aggregated toner powder is agitated by an agitator to be dissociated, the toner continues Brownian movement before the toner is separated into super fine particles. The time during which Brownian movement is performed depends on the surface area thereof but is independent of the specific gravity of the aggregated toner. Therefore, when a toner is pneumatically transported using a gas, it takes a very long time until the toner is separated from the gas used for transporting the toner.

Figure 9:
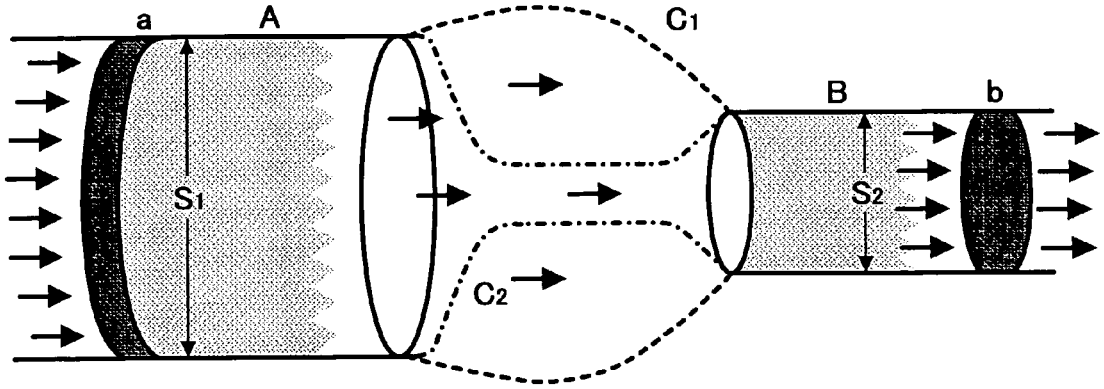
FIG. 9 is a schematic view illustrating a simple powder filling system for explaining the toner packing method of the present invention.

FIG. 9 is a schematic view illustrating how a toner container is filled with a toner by the toner packing method and device of the present invention. In this packing system, the toner is present only in a portion located between a gas-powder separation sieve (a) which is provided on an upstream side of a fluidizing device A and a gas-powder separation sieve (b) which is provided on a downstream side of a toner container B to be filled with the toner. Namely, the toner powder cannot pass through the separation sieve. However, in reality the separation sieve (b) is provided on a portion of a filling nozzle instead of the container B.

When the area S1 of the separation sieve (a) is relatively large compared to the area S2 of the separation sieve (b), the velocity of the gas at the separation sieve (b) is greater than that at the separation sieve (a) by S1/S2. Therefore, even when the velocity of the gas at the separation sieve (a) is slow, the toner powder can be fluidized by the gas at a relatively high speed at the separation sieve (b), and thereby the toner powder can be rapidly discharged to the container B. This mechanism is very useful for the current OA machines which are required to have a small size, a light weight and a high efficiency and therefore use a small toner (or developer) container having a small opening through which the toner (or developer) is contained and discharged.

Referring to FIG. 9, the velocity of the gas (or the powder) at the separation sieve (b) is not changed whether the diameter of the midway path (C1 or C2) is wide or narrow.

When the area S1 is larger than the area S2, the pressure of the gas flown to fluidize the powder at the separation sieve (a) should be theoretically slightly higher than the discharging pressure (i.e., 1 atom, i.e., $1.01325\times10^5$ Pa) of the gas (or the powder) at the separation sieve (b). However, a pressure drop can occur by reason that the flown gas has a viscosity, friction is caused between the gas (or powder) and the inside wall of the filling machine, and the volume of the flown gas is reduced.

Therefore, the pressure of the gas supplied to fluidize the powder at the separation sieve (a) is preferably slightly higher than 1 atom (i.e., $1.01325\times10^5$ Pa). When the pressure is too high, the capturing effect of the fine particles floating in the container deteriorates. The pressure is determined depending on the amount of the fine particles floating in the container and the state of the fluidized fine particles. However, when a urethane tube with a length not greater than 3.5 m is used as the toner feeding tube, the pressure is ordinarily from 2 to 1500 hPa in gauge pressure, preferably from 3 to 800 hPa, and more preferably from 10 to 500 hPa. When the pressure is too low, it takes a long time to fill the container with the toner.

In this regard, the separation sieves (a) and (b), which are a gas-powder separation sieve, are targeted at the same fine powder. Therefore, the same material can be used for the separation sieves. Suitable materials for use as the separation sieves (i.e., air-flow plates) include sintered metal plates, metal meshes and sintered resin panels.

In the toner packing method of the present invention, it is very important to select a proper sieve. In particular, it is very difficult to select such a proper sieve for fine powders (such as toners) as to have characteristics such that air flowing can be performed even at a relatively low pressure while being used for a long period of time without causing clogging. The present inventors discover that it is preferable that a sintered resin panel (tradenamed as FILTEREN® manufactured by Filteren Co., Ltd.) is used as the separation sieve and the sintered resin panel (i.e., the separation sieve) is sandwiched between an acrylic cylinder and a lower flange. Therefore, the sintered resin panel is used for the embodiment mentioned below to allow the powder (i.e., the toner) to achieve a stable fluidized state. GORE-TEX manufactured by Japan Gore-tex Inc. and sintered metal plates can be used as the air-flowing plate, but the sintered resin panel (FILTEREN®) is preferable in view of uniformity in air flowing.

The toner packing method of the present invention preferably includes the following steps:

(1) discharging a gas (such as air, hereinafter referred to as air) into a toner to be fed which is contained in a closed container of the fluidizing device while controlling the pressure of air using a control valve to control the pressure in the fluidizing device and to uniformly fluidize the toner using a gas supplying device which can uniformly feed a gas (such as air, hereinafter referred to as air) to the toner; and (2) feeding the toner from the fluidizing device to fill a toner container with the toner.

By providing such a gas supplying device, air can be gradually fed into the powder fluidizing device and thereby the toner can be fluidized while the Brownian movement of the toner is prevented. After the toner is fluidized, the toner has a high fluidity, and thereby the toner can be discharged from the powder fluidizing device only by heightening the pressure in the powder fluidizing device so as to be slightly higher than the outside pressure (i.e., 1 atom=101.3 kPa). Thus, the toner can be pneumatically transported smoothly to the filling nozzle through the transport passage. Therefore, the toner can be contained in the toner container without performing additional agitation.

When air is fed into the fluidizing device to fluidize the toner, it is possible to flow air from a portion other than the fluidizing device. In this case, it is very important to uniformly introduce air. Therefore, it is preferable to introduce air through a gas distributor such as meshes having small openings in order to prevent pressure loss. When the fluidized toner is discharged and contained in a toner container, the start and end of the packing operation are preferably controlled by rapidly adjusting the pressure in the fluidizing device, for example, by using an open valve provided on the fluidizing device. In addition, a pressing device which is provided outside of the fluidizing device can be used as an auxiliary device.

In addition, it is preferable to provide a gas flow rate adjusting member (such as valves) to finely adjust the pressure in the fluidizing device and the passage through which the toner is transported, during the toner packing operation. In addition, by adjusting the flow rate adjusting member, the flowing conditions at the beginning and mid-stream of the toner packing operation can be changed.

The fluidizing container in which the toner and air are contained and which is closed is wiggled to fluidize the toner therein. Then the inside of the fluidizing container is pressurized to feed the toner. The pressurizing operation can be performed by decreasing the internal volume of the fluidizing container. For example, the fluidizing container is pressed to decrease the internal volume thereof. Thus, the toner therein is fed from the container and is pneumatically transported to the edge of the filling nozzle, and thereby the toner container is filled with the toner. When this method is used, a fluidizer for fluidizing the toner is not necessary or at least a small-size device can be used as the fluidizer.

The fluidizing container can have such a size and weight as to be shaken by hands. Alternatively, the fluidizing container may have such a size and weight as to be easily shaken or oscillated by a pump used for introducing air to pressurize the fluidizing container. By containing a predetermined amount of toner in a small-size container which serves as the fluidizing container, the container can be used for filling only one toner container with the toner.

The toner packing method and device of the present invention will be explained in detail referring to drawings.

Example 1 of Toner Packing Device

Figure 10:
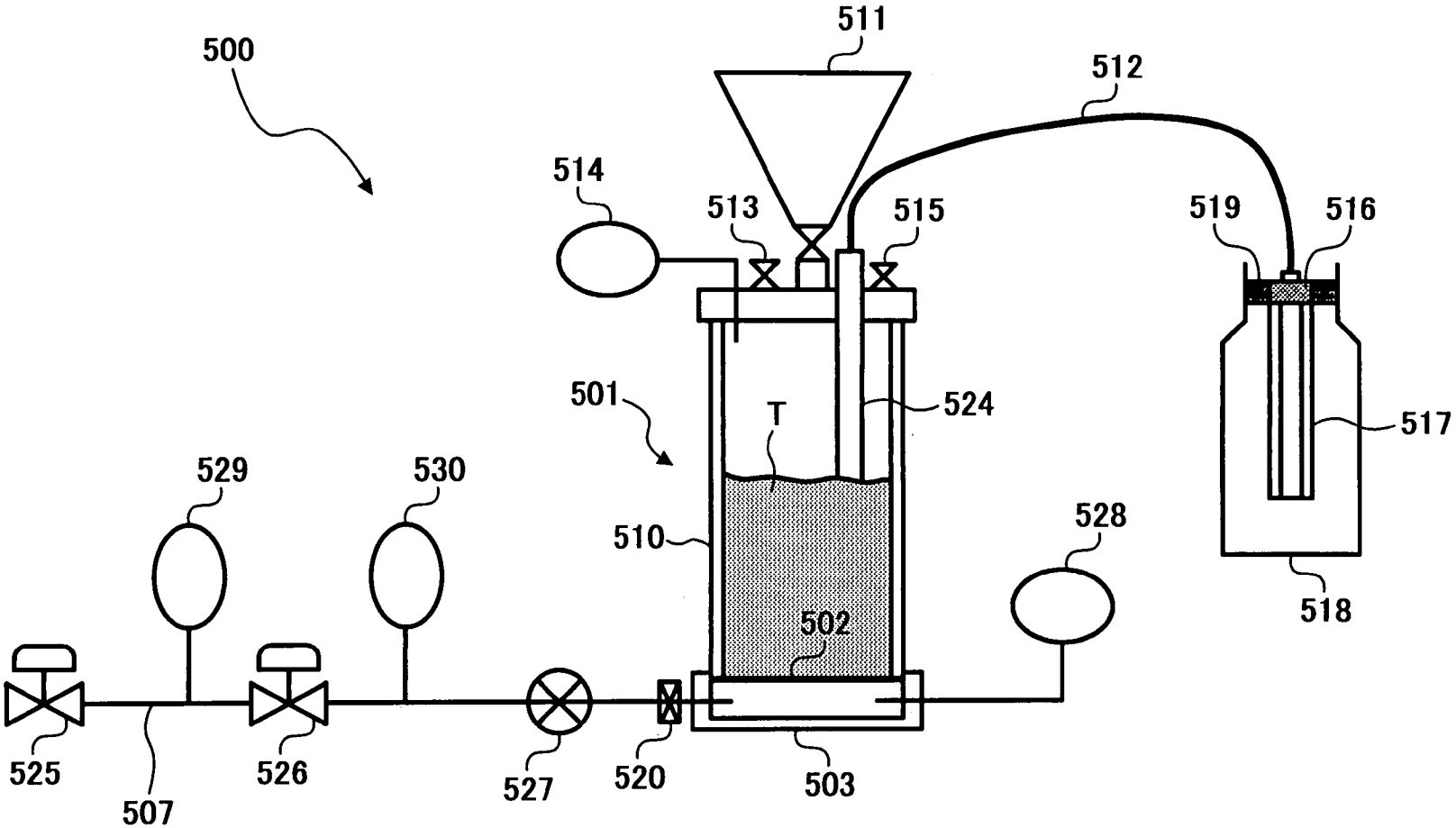
FIG. 10 is a schematic view illustrating an embodiment of the toner packing device of the present invention.

FIG. 10 is a schematic view illustrating an embodiment of the toner packing device for use in the toner packing method of the present invention. Referring to FIG. 10, a toner packing device 500 includes a fluidizing device 501 which has a fluidizing container 510 being in a closed state ordinarily and which is configured to fluidize a toner T; and a gas-powder separation sieve 502 which is detachably attached, using a flange, to an opening formed on a lower portion of the fluidizing container 510 and which passes only gasses to fluidize the toner T in the container fluidizing 510. The separation sieve 502 is typically made of a sintered resin plate, a sintered metal plate or a metal screen having small openings, and is preferably made of a sintered resin plate. The toner packing device 500 also includes a compressed air introducing tube 507, on an end portion of which an air flow adjusting valve 520 is provided; and an air header 503 with which the compressed air introducing tube 507 is detachably engaged.

Further, the toner packing device 500 includes a hopper 511 with a closing valve, from which the toner to be contained is thrown in; an open valve 513 configured to adjust the internal pressure of the container 510; a powder flow rate adjusting valve 515 configured to finely adjusting the flow rate of the toner to be transported; a pressure gauge 514 configured to measure the internal pressure of the container 510; a powder feeding tube 524 through which the toner is fed; a powder transporting tube 512 which is typically made of a polyurethane tube and which transports the toner to a toner container 518; and a filling nozzle 517 which is detachably provided on an end portion of the powder feeding tube 524 and from which the toner is discharged to the toner container 518. On an end portion of the filling nozzle 517, a gas-powder separation sieve 516 is provided. The gas-powder separation sieve 16 is engaged with a soft packing 519 made of a polypropylene ring having a frustum form, and the packing 519 is engaged with a mouth of the toner container 518.

The air header 503 can withstand pressure even when the internal pressure of the container 510 is increased, and a pressure gauge 528 is provided to measure the pressure in the air header 503. In addition, a first pressure reducing valve 525, a second pressure reducing valve 526 and an air flowmeter 527 are provided on the compressed air introducing tube 507. Further, a first pressure gauge 529 is provided between the first and second pressure reducing valves 525 and 526, and a second pressure gauge 530 is provided between the second pressure reducing valve 526 and the air flowmeter 527. Suitable containers for use as the toner container 518 include transparent toner containers made of a transparent resin.

The toner containing operation will be explained. At first, a toner to be contained in the toner container 518 is thrown into the container 510 from the hopper 511. At this point, the open valve 513 is opened. The powder flow rate adjusting valve 515 can be operated manually or automatically using an electromagnetic valve.

Then the open valve 513 is closed and air is fed from the compression air introducing tube 507 to the air header 503, which serves as a pressed air container. The pressure and flow rate of air can be adjusted by the first pressure reducing valve 525 and the second pressure reducing valve 526, and the air flow is continued when the toner packing device 500 is operated.

The thus fed air passes through the gas-powder separation sieve 502 and thereby the air is uniformly dispersed into the toner, resulting in fluidization of the toner T. On the other hand, the filling nozzle 517, which has an end slantingly cut or an end having a projection so as not to closely contact the bottom surface of the toner container 518, is inserted into the toner container 518, before the open valve 513 is closed. The toner T is fed toward the toner container 518 from the fluidizing container 510 through the powder transporting tube 512 due to the pressure of the air used for fluidizing the toner T. Thus, the toner is discharged from the filling nozzle to the toner container 518.

At the beginning of the toner discharging process (i.e., when the toner is discharged to an empty toner container), the openness of the powder flow rate adjusting valve 515 is preferably adjusted to control the speed of the toner T fed from the fluidizing device 501 so as to be relatively low, in order to prevent the toner from scattering in the toner container 518. When the toner cloud formed in the toner container 518 surrounds the following toner particles discharged from the tip of the filling nozzle 517, the openness of the powder flow rate adjusting valve 515 is gradually increased to increase the powder flow rate.

The filling nozzle 517 is set on an upper portion of the toner container 518. The filling nozzle 517 can be set automatically or manually after the toner container 518 is set. After filling the toner container 518 with a predetermined amount of toner, the opening valve 513 is opened to reduce the internal pressure of the fluidizing container 510, resulting in stopping of the toner transport operation.

In order to rapidly increase the internal pressure of the fluidizing container 510, which internal pressure is a driving force for the toner transporting, another compression air introducing nozzle other than the compression air introducing tube 507 can be provided on a portion of the fluidizing device 501, which portion is located over the surface of the toner T contained in the fluidizing container 510.

The filling nozzle 517 can be a simple tube or a double tube as illustrated in FIG. 10 in which a portion of the outside wall is made of a fine metal screen having openings of 3000 mesh or a sintered plastic such that gasses can pass through the wall, resulting in reduction of the pressure applied between the inside and outside walls by utilizing the gas injection effect. By using such a double tube, the air included in the transported toner is removed, and thereby the apparent density of the toner contained in the toner container 518 can be increased.

Example 2 of Toner Packing Device

Figure 11:
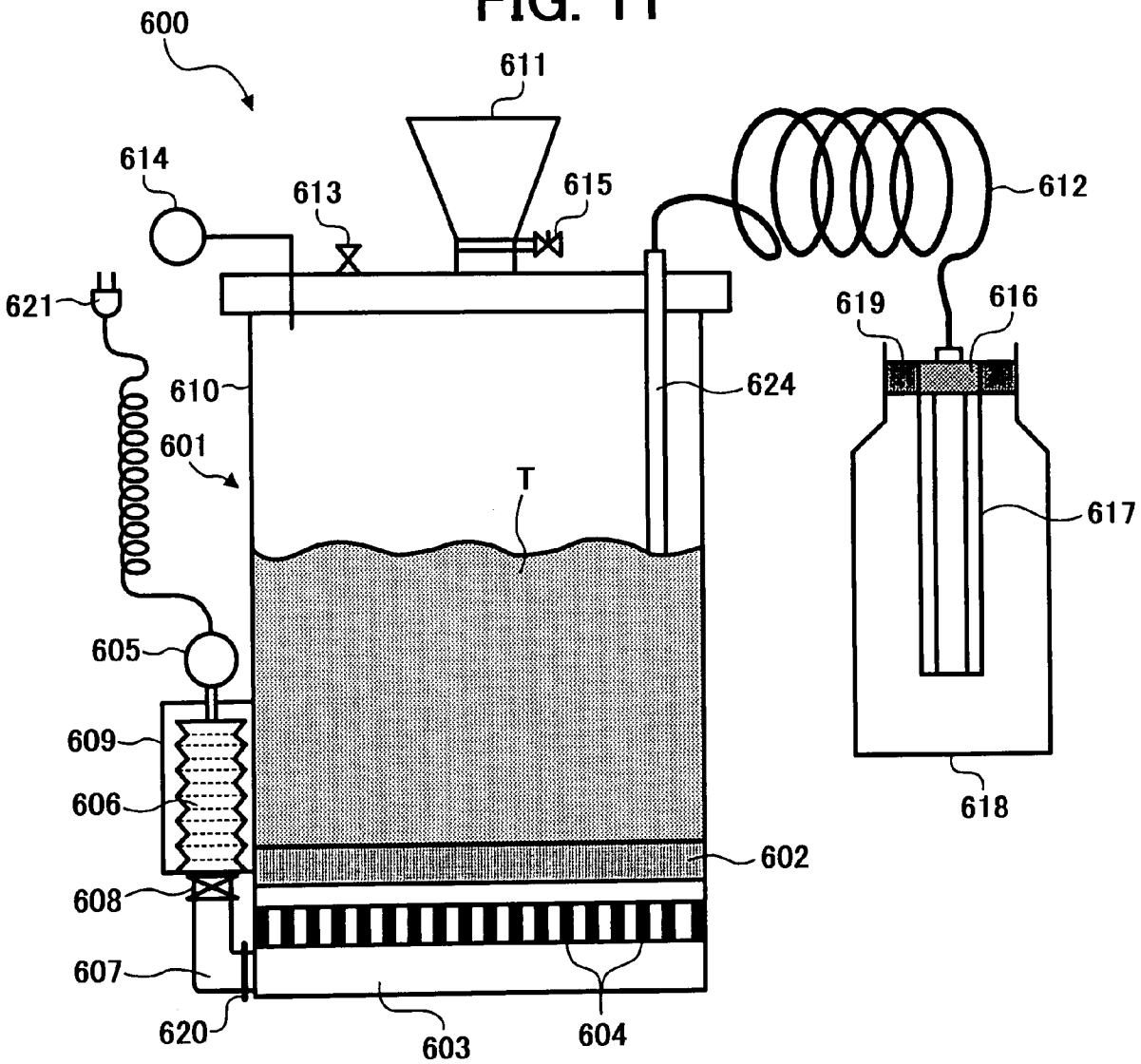
FIG. 11 is a schematic view illustrating another embodiment of the toner packing device of the present invention.

FIG. 11 is a schematic view illustrating another embodiment of the toner packing device for use in the toner packing method of the present invention.

A toner packing device 600 includes a fluidizing device 601 which includes a fluidizing container 610 made of a flexible material such as soft plastics; a gas-powder separation sieve 602 which is detachably attached, using a flange, to an opening formed on a lower portion of the fluidizing device 601 and which passes only air to fluidize the toner T in the fluidizing container 610. As mentioned above, the separation sieve is made of a sintered resin plate, a sintered metal plate or a metal screen having small openings, and is preferably made of a sintered resin plate.

The toner packing device 600 also includes a compressed air introducing tube 607, on an end portion of which the gas flow adjusting valve 620 is provided; and an air header 603 with which the compressed air introducing tube 607 is detachably engaged.

Further, the toner packing device 600 includes a hopper 611 with a powder flow rate adjusting valve 615 configured to finely adjusting the flow rate of the toner to be transported; an open valve 613 configured to adjust the internal pressure of the fluidizing container 610; a pressure gauge 614 configured to measure the internal pressure of the fluidizing container 610; a powder feeding tube 624 from which the toner T is discharged; a powder transporting tube 612 which is typically made of a polyurethane tube and which transports the toner T to a toner container 618; and a filling nozzle 617 which is detachably provided on an end portion of the powder transporting tube 612 and from which the toner T is discharged to the toner container 618. On an end portion of the filling nozzle 617, a gas-powder separation sieve 616 is provided. The gas-powder separation sieve 616 is engaged with a soft packing 619 made of a polypropylene ring having a frustum form, and the packing 619 is engaged with a mouth of the toner container 618.

The main differences between the toner packing devices of Examples 1 and 2 are as follows. The toner packing device 600 has an accordion-form pump 606 which has a check valve (i.e., a non-return valve) 608 on an exit thereof and which can be extended and contracted by a motor 605 to feed air to the air header 603. The pump 606 is detachably fixed to a housing 609. When the motor 605 is activated and thereby the pump 606 is extended and contracted, the fluidizing container 610 is vibrated, and thereby the toner T in the fluidizing container 610 is fluidized.

An air distributor 604 is provided in the air header 603 to uniformly distribute air to uniformly fluidize the toner T.

Numeral 621 denotes a plug of the motor 605.

The toner packing device 600 of Example 2 has the following advantages:

(1) it is not necessary for the fluidizing container 610 and the air header 603 to have a thick wall because the toner T therein can be fluidized by vibration instead of addition of pressure, resulting in miniaturization and weight saving of the toner packing device 600; and (2) by inserting the plug 621 of the motor 605 into an outlet provided on, for example, an image forming apparatus, the toner packing device 600 can be operated.

Example 3 of Toner Packing Device

Other embodiments of the toner packing device of the present invention will be explained.

It is available to press a deformable closed container which is made of a soft plastic such as polyethylene and has an exit connected with a tube such as polyurethane tubes and which includes a toner and gas (such as air) therein, for example by man-power, to deform the container and to feed the toner therein to the toner container.

Alternatively, a non-deformable container which is made of a hard plastic and has two exits can be used. Compressed air having a pressure not greater than 0.2 MPa is injected into a fluidizing container from one of the exits thereof to feed the toner in the fluidizing container to a toner container through the other of the exits of the non-deformable container and a tube connected with a lower portion of the container. Suitable compressed air sources include compressors, inflators, etc.

In the toner packing device for use in the toner packing method of the present invention, it is preferable that the ratio of the area of the gas-powder separation sieve 502 (or 602) to the area of the gas-powder separation sieve 516 (or 616) is not less than 1.002 to increase the air flowing speed at the gas-powder separation sieve 516 (or 616) and thereby the toner T can be smoothly discharged to the toner container.

As mentioned above, the toner can be transported to the toner container by increasing the internal pressure of the fluidizing container or applying a pressure from outside to the fluidizing container to reduce the volume of the container.

When a toner having a volume average particle diameter of from 0.2 μm to 20 μm is used as the toner T, these toner packing device can particularly deliver good performance.

Having generally described this invention, further understanding can be obtained by reference to certain specific examples of toners which are provided herein for the purpose of illustration only and are not intended to be limiting. In the descriptions in the following examples, the numbers represent weight ratios in parts, unless otherwise specified.

EXAMPLES

Example 1

Preparation of Unmodified Polyester

The following components were contained in a reaction container having a condenser, a stirrer and a nitrogen introducing tube and reacted for 8 hours at 230° C. under normal pressure to perform a polycondensation reaction.

| | |
|---|---|
| Adduct of bisphenol A with 2 mole of ethylene oxide | 690 parts |
| Terephthalic acid | 256 parts |

Then the reaction was further continued for 5 hours under a reduced pressure of from 10 to 15 mmHg, followed by cooling to 160° C. Further, 18 parts of phthalic anhydride were added thereto to perform a reaction for 2 hours at 160° C. Thus, an unmodified polyester (B) was prepared.

Preparation of Prepolymer

The following components were contained in a reaction container having a condenser, a stirrer and a nitrogen introducing tube and reacted for 8 hours at 230° C. under normal pressure.

| | |
|---|---|
| Adduct of bisphenol A with 2 mole of ethylene oxide | 800 parts |
| Isophthalic acid | 180 parts |
| Terephthalic acid | 60 parts |
| Dibutyl tin oxide | 2 parts |

Then the reaction was further continued for 5 hours under a reduced pressure of from 10 to 15 mmHg while removing water, followed by cooling to 160° C. Further, 32 parts of phthalic anhydride were added thereto to perform a reaction for 2 hours at 160° C.

Then the reaction product was cooled to 80° C., and reacted with 170 parts of isophorone diisocyanate in ethyl acetate for 2 hours. Thus, a prepolymer (A) having an isocyanate group was prepared.

Preparation of Ketimine Compound

In a reaction container having a stirrer and a thermometer, 30 parts of isophorone diamine and 70 parts of methyl ethyl ketone were contained and reacted for 5 hours at 50° C. to prepare a ketimine compound (1).

Preparation of Toner Particles

In a beaker, 14.3 parts of the prepolymer (A), 55 parts of the polyester (B) and 78.6 parts of ethyl acetate were mixed to prepare a solution. Then 10 parts of a rice wax serving as a release agent and having a melting point of 83° C., and 4 parts of a copper phthalocyanine blue pigment were added to the solution and the mixture was agitated by a TK HOMOMIXER for 5 minutes at 60° C. and at a revolution of 12,000 rpm, followed by dispersion for 60 minutes at 20° C. using a bead mill. Thus, a toner composition liquid (1) was prepared.

Further, in a beaker, 306 parts of deionized water, 265 parts of a 10% suspension of tricalcium phosphate, 0.2 parts of sodium dodecylbenzene sulfonate were mixed to prepare a solution. Then the solution was mixed with 161.9 parts of the toner composition liquid (1) and 2.7 parts of the ketimine compound (1) using a TK HOMOMIXER at a revolution of 12,000 rpm to perform a urea reaction. In this case, the particle diameter and particle diameter distribution of the particles were checked using a microscope. If the particle diameter was too large, the mixing operation was further continued for 5 minutes at a revolution of 14,000.

The thus prepared emulsion was contained in a tank having a stirrer and a thermometer, and heated to 45° C. Then the emulsion was agitated for 2 hours by the stirrer having a peripheral speed of 10.5 m/sec to prepare a dispersion including mother toner particles having a spindle form. In this case, if the spindle form is not a desired form, the agitation is further continued.

The thus prepared dispersion was subjected to a solvent-removing treatment under normal pressure (i.e., 101.3 kPa). It took 20 hours until the solvent was removed. Then the dispersion was subjected to filtering, washing, drying and air classifying. Thus, dry mother toner particles having a spindle form were prepared.

One hundred (100) parts of the thus prepared mother toner particles and 0.25 parts of a charge controlling agent (BONTRON E-84 from Orient Chemical Industries Ltd.) were mixed in a Q-form mixer manufactured by Mitsui Mining Co., Ltd., under the following conditions:

Peripheral speed of turbine blade: 50 m/sec; and

Mixing operation: a cycle in which rotation is performed for 2 minutes followed by a pause for 1 minute was performed 5 times.

Further, 0.5 parts of a hydrophobized silica (H2000 from Clariant Japan) were added to the toner particles, and the mixture was agitated by the Q-form mixer under a mixing condition such that a cycle in which rotation is performed for 0.5 minutes followed by a pause for 1 minute was performed 5 times.

Figure 8A:
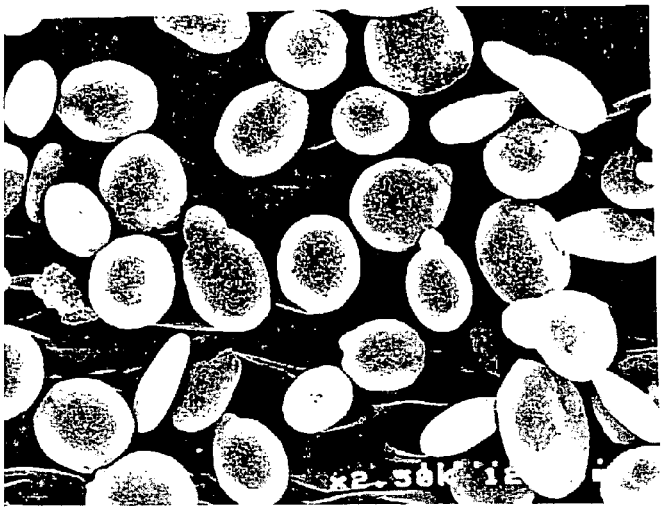
FIGS. 8A to 8C are photocopies of photographs of the toner particles prepared in Example 1, and Comparative Examples 1 and 2, respectively.

Furthermore, 0.5 parts of a hydrophobized silica and 0.5 parts of a hydrophobized titanium oxide were mixed with the toner particles using a Henschel mixer. Thus, a cyan toner of the present invention was prepared. The photograph of the toner particles is shown in FIG. 8A. In addition, the physical properties of the toner are shown in Table 2.

Example 2

The procedure for preparation of the toner in Example 1 was repeated except that the pressure in the solvent removing treatment was changed from 101.3 kPa to 90 kPa to prepare a toner of Example 2. It took 12 hours until the solvent was removed from the dispersion in the solvent removing treatment.

The physical properties of the thus prepared toner are shown in Table 2.

Example 3

The procedure for preparation of the emulsion in Example 1 was repeated. Then the solvent removing treatment was performed as follows.

The emulsion was contained in a tank having a stirrer and a thermometer, and heated to 45° C. Then the emulsion was agitated for 2 hours by the stirrer having a peripheral speed of 10.5 m/sec to prepare a dispersion including mother toner particles having a spindle form. In this case, if the spindle form is not a desired form, the agitation is further continued.

The thus prepared dispersion was subjected to a solvent removing treatment at 45° C. under a pressure of 30 kPa while nitrogen gas was supplying thereto at a flow rate of 1.0 L/min. It took 9.5 hours until the solvent was removed. Then the dispersion was subjected to filtering, washing, drying and air classifying. Thus, dry mother toner particles having a spindle form were prepared.

The physical properties of the thus prepared toner are shown in Table 2.

Example 4

The procedure for preparation of the toner in Example 3 was repeated except that the flow rate of nitrogen gas was changed from 1.0 L/min to 10.0 L/min. It took 4.5 hours until the solvent was removed.

The physical properties of the thus prepared toner are shown in Table 2.

Example 5

The procedure for preparation of the emulsion in Example 1 was repeated. Then the solvent removing treatment was performed as follows.

The emulsion was continuously supplied to a continuous vacuum defoaming device, BUBBLE BUSTER® 600 from Ashizawa Fine Tech Co., Ltd. The treatment conditions were as follows.

| | |
|---|---|
| Peripheral speed of outer end of bucket: | 8 m/sec |
| Pressure in the basket: | 30 kPa |
| Amount of nitrogen gas supplied: | 10% by volume based on dispersion to be treated |

The thus prepared mother toner particles having a spindle form were treated in the same way as performed in Example 1 to prepare a cyan toner of Example 5.

The physical properties of the thus prepared toner are shown in Table 2.

Example 6

The procedure for preparation of the toner in Example 5 was repeated except that the peripheral speed of outer end of the bucket was changed to 65 m/sec and the feed rate of nitrogen gas was changed to 2% by volume based on the dispersion to be treated.

The physical properties of the thus prepared toner are shown in Table 2.

Example 7

The procedure for preparation of the toner in Example 5 was repeated except that the peripheral speed of outer end of the bucket was changed to 40 m/sec.

The physical properties of the thus prepared toner are shown in Table 2.

Comparative Example 1

The procedure for preparation of the toner in Example 1 was repeated except that the shape controlling operation was not performed. The resultant mother toner particles had a spherical form.

The mother toner particles were treated in the same way as performed in Example 1 to prepare a toner of Comparative Example 1.

Figure 8B:
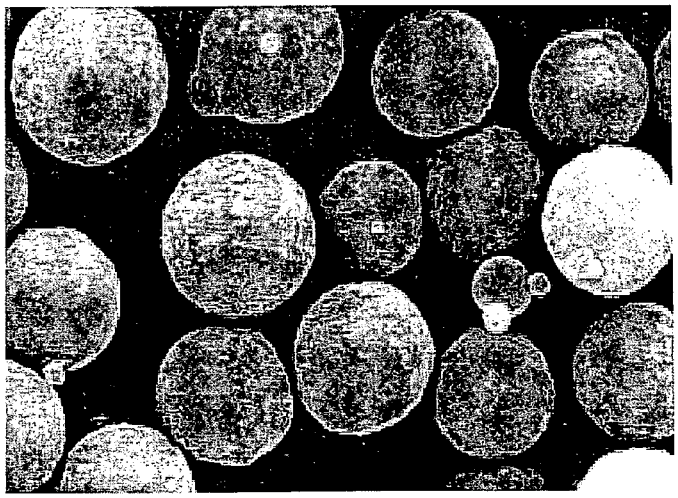

The photograph of the toner particles is shown in FIG. 8B. In addition, the physical properties of the toner are shown in Table 2.

Comparative Example 2

A toner was prepared by a dry pulverization method using the following components.

| | |
|---|---|
| Polyester resin (reaction product of a bisphenol type diol with a polycarboxylic acid, number average molecular weight (Mn) of 6,000, weight average molecular weight (Mw) of 50,000, glass transition temperature of 61° C.) | 86 parts |
| Rice wax (acid value of 0.5 mgKOH) | 10 parts |
| Copper phthalocyanine blue pigment (from Toyo Ink Mfg. Co., Ltd.) | 4 parts |

The components were mixed using a Henschel mixer, and the mixture was kneaded for 40 minutes at a temperature of from 80 to 110° C. using a roll mill. The kneaded mixture was cooled to roomtemperature, followed bypulverization and classification, to prepare mother toner particles.

The thus prepared mother toner particles were treated in the same way as performed in Example 1 to prepare a toner.

Figure 8C:
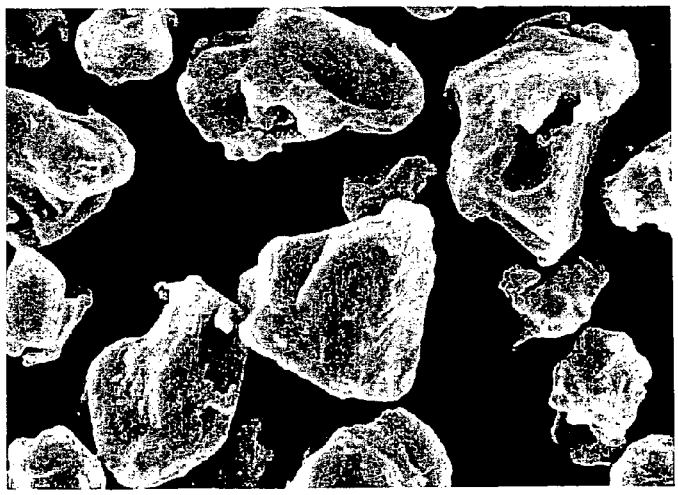

The photograph of the toner particles is shown in FIG. 8C. In addition, the physical properties of the toner are shown in Table 2.

The conditions for the shape controlling operation and the solvent removing treatment are shown in Table 1.

TABLE 1

| | Device used | Peripheral speed m/sec | Pressure Kpa | Inert gas used: Gas | Inert gas used: Flow rate L/min | Inert gas used: Flow rate Vol. % |
|---|---|---|---|---|---|---|
| Ex. 1 | Tank | 10.5 | 101.3 | none | 0 | — |
| Ex. 2 | Tank | 10.5 | 90 | none | 0 | — |
| Ex. 3 | Tank | 10.5 | 30 | nitrogen | 1 | — |
| Ex. 4 | Tank | 10.5 | 30 | nitrogen | 10 | — |
| Ex. 5 | BUBBLE BUSTER ® 600 | 8 | 30 | nitrogen | — | 10 |
| Ex. 6 | BUBBLE BUSTER ® 600 | 65 | 30 | nitrogen | — | 2 |
| Ex. 7 | BUBBLE BUSTER ® 600 | 40 | 30 | nitrogen | — | 10 |
| Comp. Ex. 1 | The shape controlling operation was not performed. | | | | | |
| Comp. Ex. 2 | This toner was manufactured by a pulverization method. | | | | | |

TABLE 2

| | Dv (μm) | r1 (μm) | r2 (μm) | r3 (μm) | r2/r1 | r3/r2 | Standard deviation (μm) S1 | S2 | S3 | SF-2 | C* (wt. %) |
|---|---|---|---|---|---|---|---|---|---|---|---|
| Ex. 1 | 6.1 | 7.1 | 5.6 | 5.4 | 0.79 | 0.96 | 2.1 | 1.7 | 1.6 | 110 | 12 |
| Ex. 2 | 5.9 | 6.9 | 5.5 | 5.3 | 0.80 | 0.96 | 1.9 | 1.5 | 1.4 | 118 | 12 |
| Ex. 3 | 5.0 | 6.3 | 5.0 | 4.8 | 0.79 | 0.96 | 1.6 | 1.4 | 1.3 | 122 | 20 |
| Ex. 4 | 5.0 | 6.3 | 5.0 | 4.8 | 0.79 | 0.96 | 1.5 | 1.2 | 1.1 | 128 | 11 |
| Ex. 5 | 5.0 | 6.3 | 5.0 | 4.3 | 0.79 | 0.86 | 0.8 | 0.6 | 0.5 | 133 | 7 |
| Ex. 6 | 5.2 | 7.0 | 4.5 | 4.4 | 0.64 | 0.98 | 0.5 | 0.4 | 0.4 | 180 | 35 |
| Ex. 7 | 5.1 | 6.5 | 4.7 | 4.6 | 0.72 | 0.98 | 0.5 | 0.4 | 0.4 | 140 | 15 |

TABLE 2-continued

| | Dv (μm) | r1 (μm) | r2 (μm) | r3 (μm) | r2/r1 | r3/r2 | Standard deviation (μm) S1 | S2 | S3 | SF-2 | C* (wt. %) |
|---|---|---|---|---|---|---|---|---|---|---|---|
| Comp. Ex. 1 | 5.3 | 5.3 | 5.3 | 5.3 | 1.00 | 1.00 | 0.4 | 0.4 | 0.4 | 100 | 8 |
| Comp. Ex. 2 | 5.8 | These properties could not be measured. | | | | | | | | | 22 |

C*: Content of toner particles having a particle diameter not greater than 3 μm.

Although the toners of Examples 1 to 4 have a spindle form, the standard deviations of the particle diameters r1, r2 and r3 are relatively large. Namely, the shape of the toner particles is not uniform. In contrast, the standard deviations of the particle diameters r1, r2 and r3 of the toners of Examples 5 to 7 are small. Namely, the shape of the toners is uniform. In addition, the toner of Example 6 includes a relatively large amount of toner particles having a particle diameter not greater than 3 μm.

The toners of Comparative Examples 1 and 2 have a spherical form and an irregular form, respectively, and therefore the evaluation concerning the shape was not performed thereon.

As can be understood from FIG. 8A, the toner of Example 1 has a spindle form.

Evaluation of the Toners

Three (3) parts of each toner were mixed with 97 parts of a ferrite carrier which has a size of from 100 to 250 mesh and which had been coated with a silicone resin, using a ball mill to prepare two component developers. Each of the thus prepared developers was set in an image forming apparatus having a constitution as illustrated in FIG. 5 to be evaluated with respect to developing property, transferring property and cleaning property.

The evaluation methods are as follows.

(1) Developing Property

An image chart including a line image in which 5 pairs of a black line and a white line are arranged in a portion of 1 mm wide was copied. The toner image on the image bearing member (i.e., photoreceptor) was visually observed using a loupe to evaluate the fine line reproducibility and to determine whether there are toner particles on white line images formed on the photoreceptor (i.e., to determine whether the toner scattering problem is caused in the toner image on the photoreceptor).

(2) Transfer Property

A black solid image was formed on a paper with a reel weight of 45 kg. The weight (Wp) of the toner on the paper and the weight (Wi) of the toner image on the image bearing member were measured to determine the weight ratio (Wp/Wi) (i.e., transfer rate).

In addition, the line image prepared above in paragraph (1) was transferred on a paper. The transferred toner image was visually observed to determine whether there are toner particles on while line images on the receiving paper (i.e., to determine whether the toner scattering problem is caused in the toner image on the receiving paper).

(3) Cleaning Property

Half tone images were formed on the photoreceptor and then removed by the cleaning blade to determine whether toner particles remain on the photoreceptor. This cleaning operation was performed under an environmental condition of 10° C. and 10% RH, which is a severe condition for cleaning.

The developing property, transferring property and cleaning property of the toners are graded into the following four ranks:

○: Good.

Δ: Acceptable.

X: Unacceptable.

The results are shown in Table 3.

TABLE 3

| | Developing property | | Transferring property | | Cleaning property |
|---|---|---|---|---|---|
| | Fine line reproducibility | Toner scattering | Transfer rate | Toner scattering | Amount of residual toner |
| Ex. 1 | ○ | Δ | ○ | Δ | Δ |
| Ex. 2 | ○ | ○ | ○ | Δ | Δ |
| Ex. 3 | ○ | ○ | ○ | Δ | ○ |
| Ex. 4 | ○ | ○ | ○ | Δ | ○ |
| Ex. 5 | ○ | ○ | ○ | ○ | ○ |
| Ex. 6 | ○ | Δ | ○ | ○ | ○ |
| Ex. 7 | ○ | ○ | ○ | ○ | ○ |
| Comp. Ex. 1 | ○ | X | ○ | X | X |
| Comp. Ex. 2 | X | ○ | X | ○ | ○ |

As can be understood from Table 3, with respective to developing property the toners of Examples 1 to 7 can produce high quality toner images having good fine line reproducibility without toner scattering. In particular, the toner of Example 7, whose particles have a uniform spindle form, can produce toner images excellent in toner scattering. The spherical toner of Comparative Example 1 can produce toner images having good fine line reproducibility but the white areas of the toner images are fogged (i.e., many toner particles are present on the white areas). Namely, the image qualities of the toner images deteriorate due to the background development. The toner of Comparative example 2, which has an irregular form, produce toner images having poor fine line reproducibility but background development is not observed. The image qualities of the toner of Comparative Example 2 are poorer than those of the other toners as a whole.

The toners of Examples 1 to 7 have high transfer rate without causing the toner scattering problem even when the toner images are transferred. In particular, the images of the toner of Example 7, whose particles have a uniform spindle form, are excellent in toner scattering even after the toner images are transferred. The toner of Comparative Example 1 has high transfer rate but causes the toner scattering problem. Therefore, the image qualities are slightly poor as a whole. The toner of Comparative Example 2 has low transfer rate but does not cause the toner scattering problem.

No toner particles remained on the photoreceptor even after a 100-copy running test was performed using the toners of Examples 3–7 and Comparative Example 2. In the case of the toners of Examples 1 and 2, a small amount of toner remained on the photoreceptor after the running test, although the image qualities are still acceptable. In contrast, toner particles remained on the photoreceptor when one copy was performed using the toner of Comparative Example 1. Therefore, the toner cannot be practically used.

Effects of the Present Invention

Thus, the present invention can form high quality images (i.e., good fine line reproducibility) on a photoreceptor without causing the toner scattering problem. In addition, the toner of the present invention has high transfer rate and does not cause the toner scattering problem in the transfer process. Further, the toner of the present invention has cleanability as good as that of toners having an irregular form.

In addition, by using the toner packing method of the present invention, the toner can be easily contained in a container using a packing device which is small in size, simple and portable.

This document claims priority and contains subject matter related to Japanese Patent Applications Nos. 2003-144666 and 2003-291179, filed on May 22, 2003 and Aug. 11, 2003, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for producing a toner, comprising:

dissolving or dispersing a toner constituent mixture comprising a binder resin and a colorant in an organic solvent to prepare a toner constituent mixture liquid;

dispersing the toner constituent mixture liquid in an aqueous medium comprising a particulate dispersant to prepare an emulsion; and removing the organic solvent from the emulsion while applying a shearing force to the emulsion wherein the organic solvent removing comprises: supplying the emulsion to a rotator to form a thin layer of the emulsion while applying a shearing force thereto to remove the organic solvent.

2. The method according to claim 1, wherein the organic solvent removing comprises:

supplying the emulsion to a rotator to form a thin layer of the emulsion while applying a shearing force thereto to remove the organic solvent.

3. The method according to claim 2, wherein the rotator rotates at a peripheral velocity of from 10 to 60 m/sec.

4. The method according to claim 1, wherein the organic solvent removing is performed under a pressure lower than 101.3 kPa.

5. The method according to claim 1, wherein the organic solvent removing is performed while supplying an inert gas into the emulsion to form bubbles of the inert gas in the emulsion.

6. The method according to claim 5, wherein the inert gas is nitrogen gas.

7. The method according to claim 5, wherein the inert gas is supplied in an amount of from 0.1 to 70% by volume based on the volume of the emulsion.

8. A toner comprising:

a binder resin; and a colorant, wherein the toner is produced by the method according to claim 1, and wherein the toner has a spindle form and a volume average particle diameter of form 3 to 8 μm, and satisfies the following relationships:

$$0.5 \leqq (r2/r1) \leqq 0.8,\ 0.7 \leqq (r3/r2) \leqq 1.0, \text{ and } r3 \leqq r2 < r1,$$

wherein r1, r2 and r3 represent an average major axis particle diameter, an average minor axis particle diameter and an average thickness of particles of the toner.

9. An image forming apparatus comprising:

an image bearing member configured to bear an electrostatic latent image thereon;

a developing device configured to develop the electrostatic latent image with a developer including the toner produced according to claim 1 to form a toner image on the image bearing member;

a transferring device configured to transfer the toner image onto a receiving material; and a cleaning device configured to clean a surface of the image bearing member.

10. A process cartridge for an image forming apparatus, comprising:

an image bearing member configured to bear an electrostatic latent image thereon; and a developing device configured to develop the electrostatic latent image with a developer comprising the toner produced according to claim 1 to form a toner image on the image bearing member.

* * * * *